US006474093B1

(12) United States Patent
Fink et al.

(10) Patent No.: US 6,474,093 B1
(45) Date of Patent: Nov. 5, 2002

(54) EXPANDING BARREL SYSTEM FOR COOLING BEVERAGES

(75) Inventors: Harvey S. Fink, Bloomfield Hills; Thomas E. Mahany, Royal Oak; Lawrence J. Nolan, Livonia, all of MI (US)

(73) Assignee: Cosmo Tech Development, Inc., Farmington Hills, MI (US)

( * ) Notice: Subject to any disclaimer, the term of this patent is extended or adjusted under 35 U.S.C. 154(b) by 0 days.

(21) Appl. No.: 10/000,787

(22) Filed: Oct. 23, 2001

Related U.S. Application Data

(60) Provisional application No. 60/242,488, filed on Oct. 23, 2000.

(51) Int. Cl.[7] ..... F25D 17/02
(52) U.S. Cl. ..... 62/434; 62/376; 62/457.4
(58) Field of Search ..... 62/376, 434, 457.4

(56) References Cited

U.S. PATENT DOCUMENTS

| | | | | | |
|---|---|---|---|---|---|
| 2,618,938 | A | * | 11/1952 | Booth et al. | 62/434 |
| 3,427,820 | A | | 2/1969 | Hart | |
| 3,738,372 | A | | 6/1973 | Shioshvili | |
| 3,751,727 | A | | 8/1973 | Shepard et al. | |
| 3,830,676 | A | | 8/1974 | Elkins | |
| 3,888,092 | A | * | 6/1975 | Fisher | 62/376 |
| 3,959,982 | A | | 6/1976 | Denis et al. | |
| 3,967,627 | A | | 7/1976 | Brown | |
| 4,154,245 | A | | 5/1979 | Daily | |
| 4,202,336 | A | | 5/1980 | van Gerven | |
| 4,523,594 | A | | 6/1985 | Kuznetz | |
| 4,605,006 | A | | 8/1986 | Jacques | |
| 4,688,572 | A | | 8/1987 | Hubbard et al. | |
| 4,730,463 | A | | 3/1988 | Stanfill | |
| 4,831,842 | A | * | 5/1989 | Kelley et al. | 62/457.4 |
| 4,907,308 | A | | 3/1990 | Leininger et al. | |
| 5,035,003 | A | | 7/1991 | Rinehart | |
| 5,139,169 | A | | 8/1992 | Boyer | |
| 5,174,285 | A | | 12/1992 | Fontenot | |
| 5,344,436 | A | | 9/1994 | Fontenot et al. | |
| 5,363,671 | A | | 11/1994 | Forsythe et al. | |
| 5,478,988 | A | | 12/1995 | Hughes et al. | |
| 5,704,222 | A | | 1/1998 | Hage et al. | |
| 5,732,856 | A | | 3/1998 | Fry | |
| 5,845,501 | A | | 12/1998 | Stonehouse et al. | |
| 5,871,526 | A | | 2/1999 | Gibbs et al. | |
| 5,947,334 | A | | 9/1999 | Rudick et al. | |
| 5,966,964 | A | * | 10/1999 | Pattee | 62/457.4 |
| 5,973,299 | A | | 10/1999 | Reader, Jr. | |
| 6,082,114 | A | * | 7/2000 | Leonoff | 62/457.4 |

* cited by examiner

*Primary Examiner*—Ronald Capossela
(74) *Attorney, Agent, or Firm*—Robert S. Nolan; Cantor Colburn LLP

(57) ABSTRACT

Self-contained closed-loop cooling systems and related methods for rapidly cooling individual beverage containers of different sizes to a suitable target temperature, in the range of 35° F. to 50° F. Each system includes a chiller, a coolant circuit with a hyper-chilled supply reservoir, a refrigerant circuit for cooling the reservoir, and an electronic controller to operate the system upon operator command. The chiller is preferably formed like a barrel, with a cylindrical array of hollow chill elements arranged about a cylindrical area into which a beverage container, such as beverage bottle or can is placed. Then, very cold coolant from the coolant supply is pumped through the array of chill elements to rapidly cool the beverage container, which makes physical contact with the hyper-chilled elements, which are thus excellent heat absorbers. The chill elements are preferably separated from one another by keystone spacers, and are flexibly held in place with a plurality of coil springs. An ejection device may be provided to help remove the cooled container from the array. A housing structure is preferably provided to enclose the array of chill elements, and to support an operator interface panel. A system enclosure is provided therebelow to house the coolant supply reservoir and pump and the refrigerant circuit. The coolant in the reservoir is cooled by the refrigerant circuit, preferably down to 60° F. to 100° F. below the target temperature to which the container is to be cooled.

20 Claims, 17 Drawing Sheets

EXPANDING BARREL SYSTEM FOR COOLING BEVERAGES

CROSS-REFERENCE TO RELATED APPLICATION

This application claims priority to U.S. provisional patent application Serial No. 60/242,488 filed Oct. 23, 2000 by the same inventors and the same title, the entire specification of which is incorporated herein by reference.

FIELD OF THE INVENTION

The present invention relates in general to cooling units using a plurality of elongated chill elements for rapidly chilling beverage containers and beverages retained therein, and in particular to self-contained closed-loop cooling units that use an array of elongated chill elements for rapidly chilling different sizes of closed beverage containers or the like or other objects of different sizes placed therein.

BACKGROUND OF THE INVENTION

Many beverages such as soda pop, juice, beer, wine and others are preferably consumed cold, ideally around 45° F. or even cooler, for many beverages, or slightly chilled, such as between 50° F. to 60° F., for certain wines. Ambient temperatures are typically warmer than this, so consumers typically cool the beverage by placing the beverage container and beverage in a refrigerator or a cooler full of ice, by adding ice directly to the beverage, or by placing the beverage container and beverage into a freezer for a short period of time. Cooling a beverage container and beverage within a refrigerator or cooler full of ice generally takes several hours, which is often more time than a consumer is willing to wait. Adding ice directly to a beverage often is not desired by the consumer. Placing a beverage container and beverage in a freezer hastens the cooling process, but this method has a host of problems associated with it. For example, a warm beverage container and beverage placed within a typical freezer still requires twenty minutes or more to cool them to the desired temperature, the beverage does not cool uniformly, and it often may freeze in whole or in part if left in the freezer too long.

In order to address these concerns, numerous efforts have been made and practical methods developed for rapidly chilling beverages stored within a beverage container. In general, the rapid cooling of products of various types has been known for very long time and has seen extensive use in industry for the last few decades, especially in connection with the rapid freezing of consumable food products sold in the frozen food section of most large grocery stores.

There are a number of patents directed to chilling food and beverages during processing in which the product to be chilled is passed by a conveyor or other similar transport apparatus through a cooling/freezing chamber wherein the temperature of the product is reduced. Examples of such systems and methods are disclosed in the following U.S. Patents:

U.S. Pat. Nos. 2,153,742, 3,238,736 3,427,820 4,127,008 4,157,650 4,367,630 4,739,623 5,218,826 5,551,251

However, these rapid cooling systems are generally very large and bulky. Further, due to their size and due to ventilation requirements, they have no real application in commercial establishments such as kitchens and restaurants or in institutional settings, such as college dormitories or nursing homes, much less inside of normal residential homes.

Yet another class of devices disclosed in some patents are dedicated to open loop cooling systems that cool containers for individual products such as an individual beverage can or bottle. At least the following U.S. patents disclose such devices:

U.S. Pat. Nos. 4,054,037 4,640,101 5,115,940 5,189,890 5,287,707 5,845,499 5,845,501

This class of individual cooling containers, however, involves the use of pressurized cryogenic gas or other refrigerant stored in a pressure vessel. When the pressurized refrigerant is released from the pressure vessel, the solid or liquid compressed refrigerant evaporates and thereby cools the beverage container or cooling apparatus. These devices have several disadvantages, such as the compressed refrigerant requires refilling after discharge and environmentally unfriendly refrigerants may be released to the atmosphere. Additionally, many inventions in this class require complex and expensive beverage container designs, and have the safety risk of bodily contact with the super-cold released cryogens.

There is also another class of devices disclosed in some patents that are dedicated to relatively small-size, closed-loop cooling systems, which could be used in commercial and residential environments, and that are capable of relatively rapidly cooling beverage containers or other objects of different sizes. Examples of U.S. patents that disclose concepts for utilizing the closed-loop refrigeration system for a beverage cooler include the following:

U.S. Pat. No. 6,035,660 discloses a refrigerated beverage mug having a closed-loop mechanical refrigeration system powered by an onboard power unit. The power unit includes a pressurized gas such as nitrogen or carbon dioxide that is released to the atmosphere as it powers the mechanical refrigeration system. The mechanical refrigeration system cycles refrigerant through a standard refrigeration cycle, which includes cycling the refrigerant through an evaporator section within the annular walls of the mug in a preferably spiral configuration.

U.S. Pat. No. 5,007,248 discloses a closed-loop, beverage-cooling device integrated into a vehicle air-conditioning system. The device is mounted into a vehicle and includes a refrigeration loop integrally connected with the vehicle air-conditioning system that circulates air-conditioning refrigerant through the device, and provides for evaporation of the refrigerant within the device, thereby cooling the device and the beverage retained therein.

U.S. Pat. No. 4,711,099 discloses a portable, closed-loop, beverage-cooling device specifically designed to cool a beverage stored within a standard 12-ounce can. The device uses a standard refrigeration cycle, preferably including refrigerant R-12, and it has an evaporator formed into a spiral coil that receives a 12-ounce can therein. The spiral coil evaporator has limited flexibility wherein one end may be rotated counterclockwise relative to the other, thereby expanding the coil for insertion or removal of a can.

Although a number of relatively small closed-loop cooling systems have been disclosed in the foregoing patents, the disclosed systems have several shortcomings. Specifically, there is still a need for a closed-loop rapid chilling system or unit that is able to cool containers of various shapes and sizes, that is portable, and that does not require the release of compressed gas or refrigerant to the atmosphere. No suitable system or cooling unit has been shown for quickly cooling a variety of closed beverage containers, such as 12-ounce beverage cans, 20-ounce beverage bottles, and 10-ounce juice bottles. Also, there is a need for a self-contained system or other portable system that can be readily used by consumers with very little training to quickly cool a variety of beverages retained in containers of different sizes.

It is therefore a first major object of the present invention to provide an essentially self-contained closed-loop cooling unit or system and method of rapidly and efficiently cooling closed beverage containers of varying sizes and shapes in commercial and/or residential environments. A related object is to provide a chill element cooling unit in a relatively small enclosure that is capable of receiving and holding different size containers to minimize the time required to chill the beverage therein to a desired temperature substantially below room temperature.

A second major object of the present invention is to provide a self-contained closed-loop chill element cooling unit or system that, while sophisticated internally, includes a simple-to-operate user's control panel and an essentially foolproof method for efficiently operating the cooling system, even though beverage containers (or objects) of different sizes are to be cooled inside the same overall enclosure. A related object is to provide the user with a clear and memorable visible indication and/or aural message that the cooling process is underway. Another object is to provide a system that can readily used in restaurant kitchens or in convenience stores.

A third major object of the present invention is to provide a self-contained closed loop chill element cooling unit or system that selectively modifies the cooling cycle according to the type of beverage container and beverage to be cooled, the initial temperature of the beverage, and other factors, in order to maximize the cooling rate of the beverage. A related object is to provide a cooling system that takes advantage of natural convection currents within a beverage to improve the cooling process. Another object is to provide a cooling system that takes advantage of mechanical or other mixing to improve the cooling process.

SUMMARY OF THE INVENTION

To address the aforementioned problems and achieve one or more of the foregoing objects, there are provided novel self-contained closed-loop cooling units or systems and novel methods for carrying out chill element cooling tasks with such cooling units. In accordance with a first aspect of the present invention, the chill element cooling system is a self-contained closed-loop cooling unit comprising a barrel chiller, a system enclosure for supporting and retaining the cooling system components, a hyper-chilled coolant circuit, a refrigerant circuit, and a controller.

In general, the barrel chiller portion of the cooling system receives a beverage container and absorbs heat therefrom during a cooling cycle. The barrel chiller is preferably located on top of the system enclosure and includes a plurality of chill elements, a plurality of keystone spacers, a plurality of coil springs, an ejection device, and a housing structure. The chill elements surround the beverage container in a parallel tubular array configuration resembling the staves of a barrel. A plurality of spacers attached to each chill element orient each respective element relative to the adjacent elements, and discourage elements from clinging to one another as a result of potential frost buildup between elements. The chill elements are retained in a barrel configuration by coil springs that bias the chill elements toward one another in the tubular array. A housing structure supports the chill element array and attaches the barrel chiller to the system enclosure. The housing structure may fixedly attach the barrel chiller to the enclosure, or may permit horizontal and vertical rotation. An ejection device is preferably attached to the housing structure at a rear portion of the chill element array, coaxial with the array, for urging a beverage container out of the array at the end of a cooling cycle.

During operation, the chill elements surround a beverage container and remove heat therefrom by transferring heat to a hyper-chilled coolant flowing through each of the chill elements in parallel. Each chill element connects to the coolant circuit at one end through a feed line, and at an opposing end through a return line. The coolant is circulated by a pump that draws the coolant from an insulated coolant reservoir located within the enclosure, pumps it through the barrel chiller, and returns it to the insulated reservoir. The coolant in the insulated reservoir is maintained in a hyper-chilled state by a refrigeration circuit also preferably also located within the enclosure.

The controller is preferably mounted on the side of the barrel chiller, but may be located on top of the enclosure or any other location that provides easy access for an operator. The controller coordinates the cooling process by receiving inputs from the operator and from sensors located throughout the unit and, based upon these inputs, starts, controls, and stops the cooling process in accordance with design parameters. The controller provides the cooling unit the advantage of altering the cooling process by selectively turning different chill elements on or off as necessary for speeding up or slowing down the cooling rate, for inducing natural convection currents within the beverage, or for other reasons. The controller may selectively turn on or off each chill element by using of a solenoid valve located at the coolant feed or return portion of the selected chill element, or in an alternative embodiment, the operator may selectively turn a chill element on or off by using a manual valve such as a gate valve, butterfly valve, or the like located at the coolant feed or return portion of the selected chill element.

The cooling system of the present invention provides many advantages for rapid cooling of beverage containers and the like, such as the flexibility to accept various sized beverage containers and similarly shaped objects. Specifically, the coil springs allow the diameter of the tubular array to expand and therefore to accommodate larger sized objects. In addition, the ability of the controller to selectively control coolant flow through each of the elements, and to control the overall coolant flow rate by controlling the pump, provides many elections for improving the cooling cycle.

Additionally, the use of a coolant circuit in addition to a refrigeration circuit greatly reduces the cooling time of a beverage or other object retained within the cooling unit, and requires less refrigeration capacity than a system using only a refrigeration circuit. The use of a coolant at very low or even cryogenic temperatures produces rapid cooling of the beverage because the heat transfer rate is proportional to the temperature difference between the coolant and the beverage. For example, a coolant at −80° F. circulating through the cooling unit is expected to be capable of cooling a beverage in a conventional cylindrical 12-ounce aluminum can initially at 75° F. down to a target temperature of 45° F. in a minute or less. Furthermore, the cooling unit having both a coolant circuit and a refrigeration circuit requires a much smaller refrigeration circuit than is necessary to cycle refrigerant only at very low temperatures through the chill elements of a similar cooling unit. This is because it requires less refrigeration capacity to maintain a coolant stored within an insulated reservoir at very low temperatures than it does to produce sufficient refrigerant at very low temperatures on demand to rapidly cool a beverage.

Overall, the present invention provides for small, easy to use, versatile, highly efficient, closed-loop, multiple chill element cooling units and related methods for rapidly chilling beverages retained in beverage containers.

There has been outlined, rather broadly, some of the more important features of the invention in order that the detailed description thereof that follows may be better understood, and in order that the present contribution to the art may be better appreciated. There are, of course, additional features of the invention that will be described hereinafter, which will form elements of the subject matter of the claims appended hereto. Those skilled in the art will appreciate that the conception upon which this disclosure is based may be readily utilized as a basis for the designing of other structures, methods and systems for tearing out the several purposes of the present invention. It is important, therefore, that the claims be regarded as including such equivalent constructions in so far as they do not depart from the spirit and scope of the present invention.

BRIEF DESCRIPTION OF THE DRAWINGS

In the drawings, where the same reference numerals refer to like items or features in the different views.

DETAILED DESCRIPTION OF THE PREFERRED EMBODIMENTS

The following description of the preferred embodiments is merely exemplary in nature and is not intended to limit the claimed invention or the applications or uses to which it may be put. Throughout this description, reference is and will be made to hyper-cooled coolant or fluid. This is meant to refer to coolant (or in some cases, refrigerant) which is significantly colder, such as least 40° F. colder, preferably at least 60° F. colder, and most preferably at least 75° F. colder, than the target temperature to which the beverage in the container to be cooled is supposed to reach. As is well-known, the rate of cooling is proportional to temperature difference, and thus, it is preferred in the various embodiments and methods of the present invention to circulate, through the chill elements to be described. The coolant is preferably circulated in essentially an all-liquid state, so that pressure requirements are relatively low, and the thermal capacity of the coolant per unit volume is relatively high. The coolant may be any conventional or suitable cooling liquid or fluid known to the closed-loop refrigeration and cooling industries. The coolant may also be in a partial liquid/partial gaseous state, or even an all-gaseous state, as it is circulated through the chill elements.

Detailed Description of the First Embodiment

Figure 1:
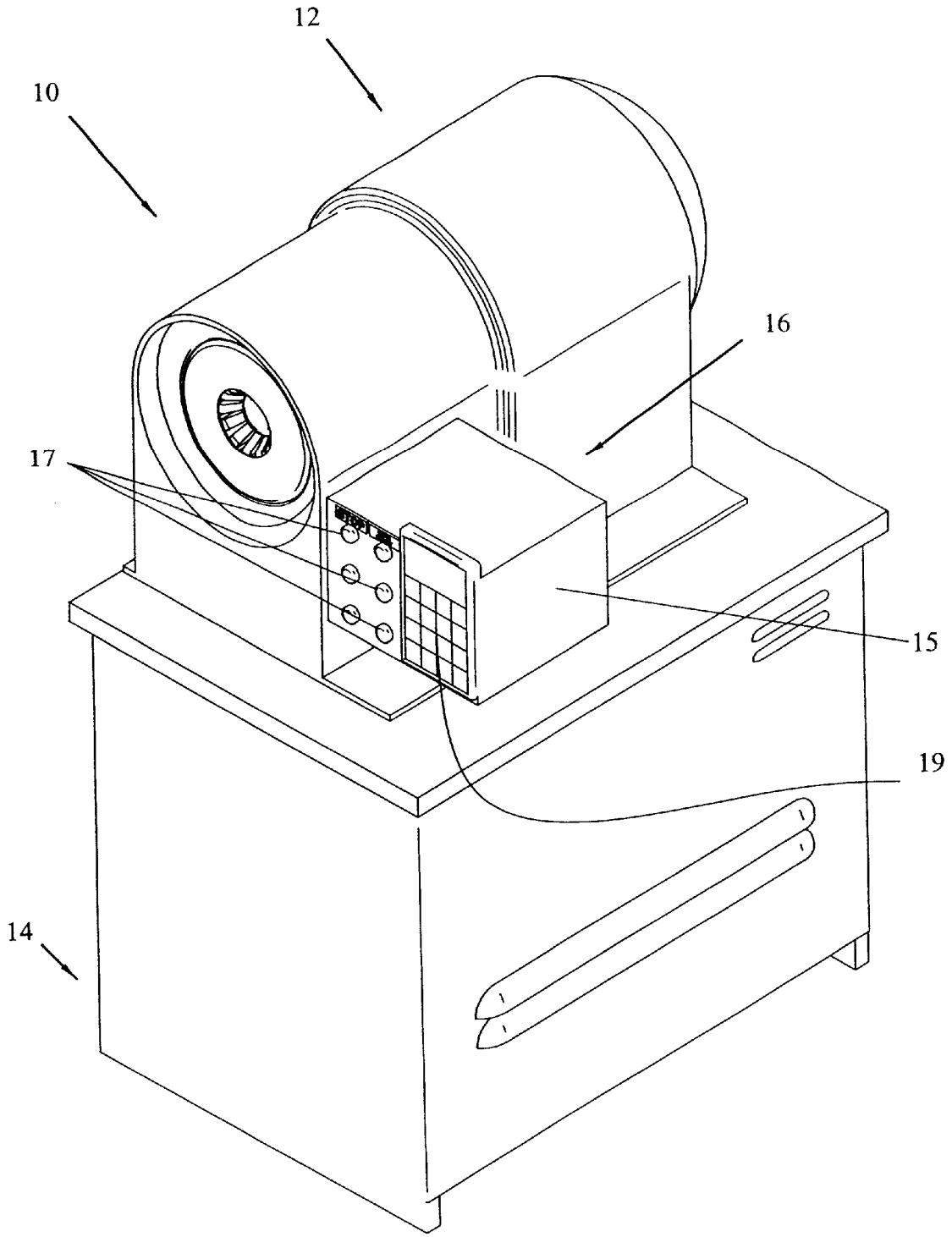
FIG. 1 illustrates, from a front perspective view, a first embodiment of the self-contained closed-loop cooling unit of the present invention, and shows the barrel chiller fixed relative to the enclosure, and the controller attached to the barrel chiller housing on the right side thereof.
Figure 2:
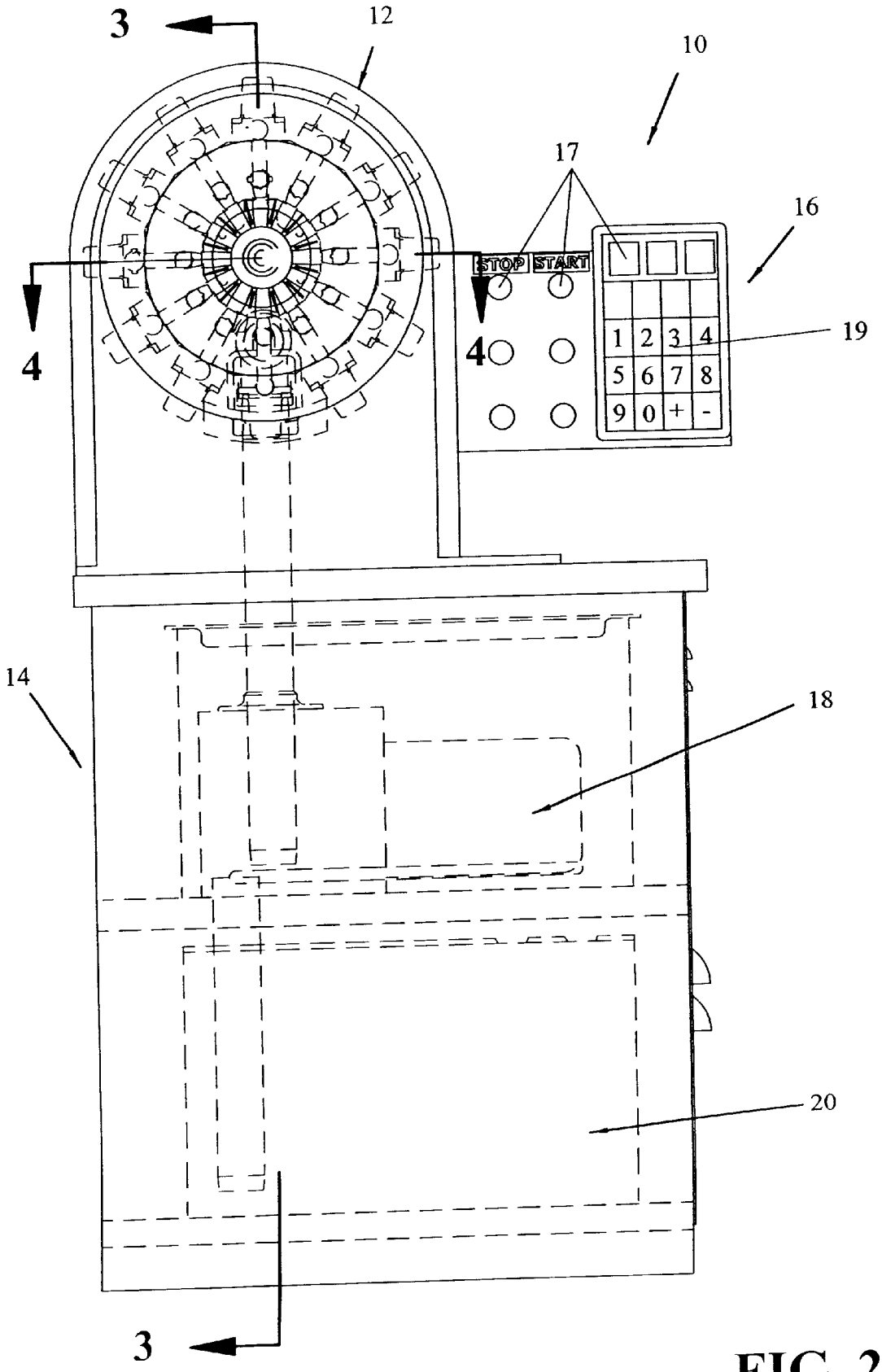
FIG. 2 is a partial cutaway front view of the cooling unit in FIG. 1, wherein the front portion of the barrel chiller housing has been removed to show the chill element array of the barrel chiller, and also showing the controller, portions of the coolant circuit primarily located within the center portion of the enclosure (shown in dashed lines), and portions of the refrigeration circuit located primarily within the lower portion of the enclosure (shown in dashed lines).

Referring to FIGS. 1 through 9, there is shown a self-contained closed-loop cooling unit and method for carrying out chill element cooling tasks in accordance with a first embodiment of the present invention. Referring to FIGS. 1 and 2, the chill element cooling system according to the first embodiment is a self-contained closed loop cooling unit 10 comprising a barrel chiller 12, a housing, a system enclosure 14, a controller 16, a hyper-chilled coolant circuit 18, and a refrigerant circuit 20.

The Barrel Chiller

Barrel chiller 12, as shown in FIGS. 3–8, is adapted to receive at least one beverage container and preferably rests on top of the system enclosure 14. The barrel chiller 12 generally includes a plurality of elongated chill elements 22, a plurality of keystone spacers 24, a plurality of coil springs 26, an ejection device 28, and a housing structure 30.

With particular reference to FIGS. 5–8, each chill element 22 is surrounded on three elongated sides by at least one, but preferably three, keystone spacers 24, which serve to properly space the element 22 in the desired configuration and to improve separation of the chill elements 22 after the cooling process is complete. The chill elements 22 and their respective spacers 24 are arranged parallel to each other in a tubular array 32 and are retained in this configuration by preferably three coil springs 26, which each surround the chill elements 22 at a different point along the length of the tubular array 32 perpendicular to the longitudinal axis of the array.

In the tubular array configuration, the chill elements 22 resemble the staves of a barrel and the coil springs 26 resemble the retention hoops, but with the difference that they are flexible. As with a standard barrel, the springs 26 act as hoops to bias the chill elements 22 against one another in the tubular configuration. However, the springs also allow the chill elements 22 to move apart from one another into expanded barrel configurations according to the size of a beverage container inserted therein. The chill element array 32 has a front tubular end 34 for receiving a beverage container into the tubular cavity 36 formed by the array, and a rear tubular end 38 at the back end of array. The front tubular end 34 preferably includes a beveled lead formed by bevels 36 in each of the chill elements 22. The bevels 36 act to expand the tubular array 32 according to the size of the object inserted therein.

Figure 6:
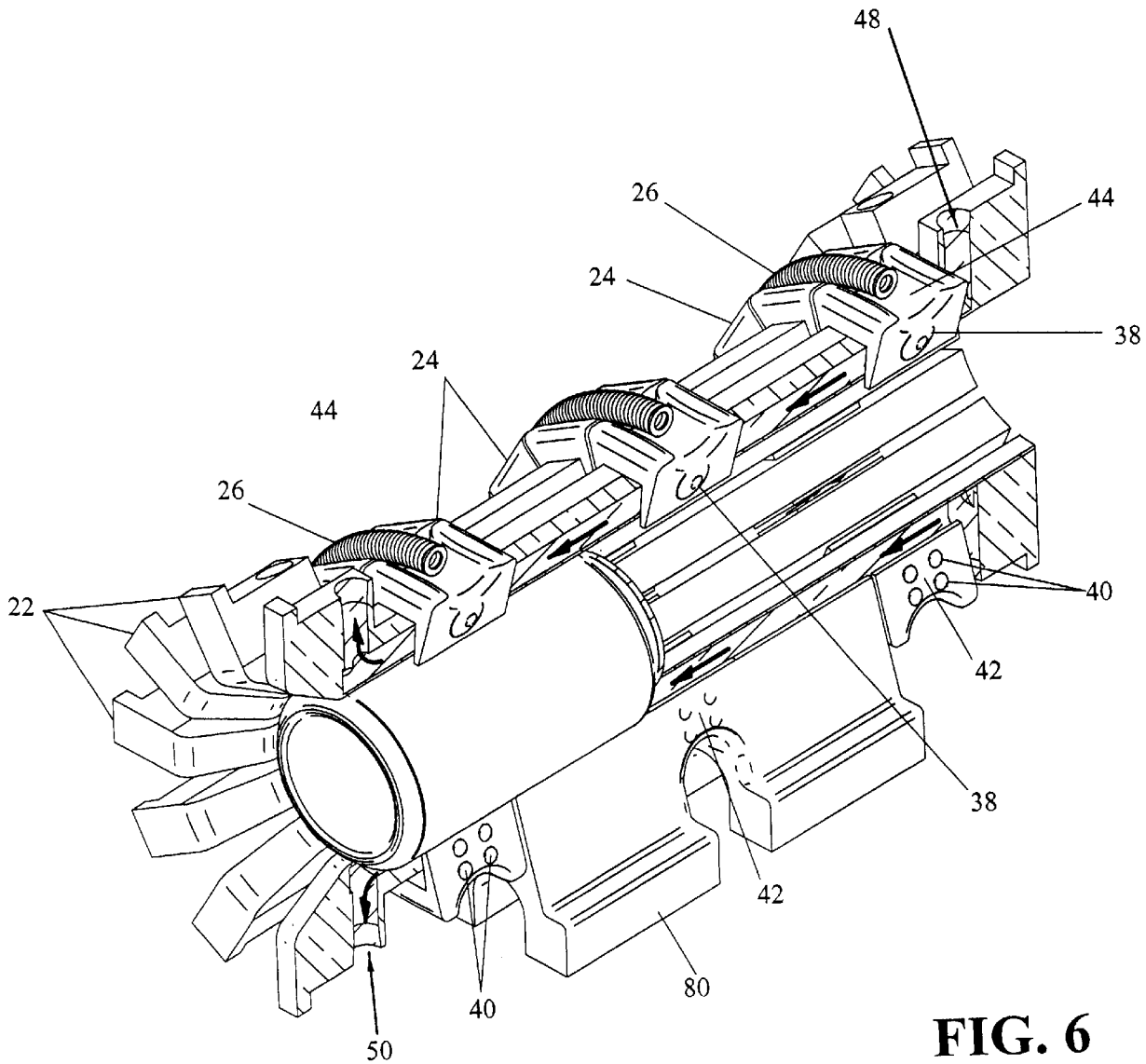
FIG. 6 is a partial cutaway view of the chill element array shown in FIG. 5, which illustrates the flow of the coolant through the chill elements, and particularly shows a plurality of contact bumps on the contact surfaces of the spacers, as well as the keystone mounting spacer that attaches the chill element array to the barrel chiller housing.
Figure 7:
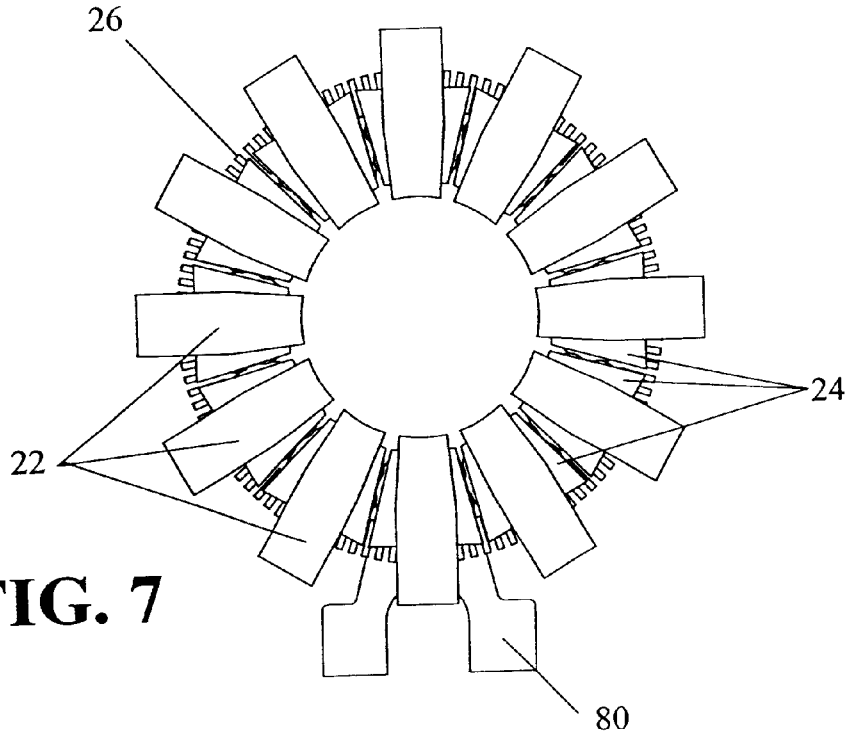
FIGS. 7 and 8 are front views of the chill element array of FIG. 5, with FIG. 7 illustrating a minimal expansion of the array when a standard soda can is inserted therein, with FIG. 8 illustrating a greater expansion of the array when a larger diameter object is inserted therein.
Figure 8:
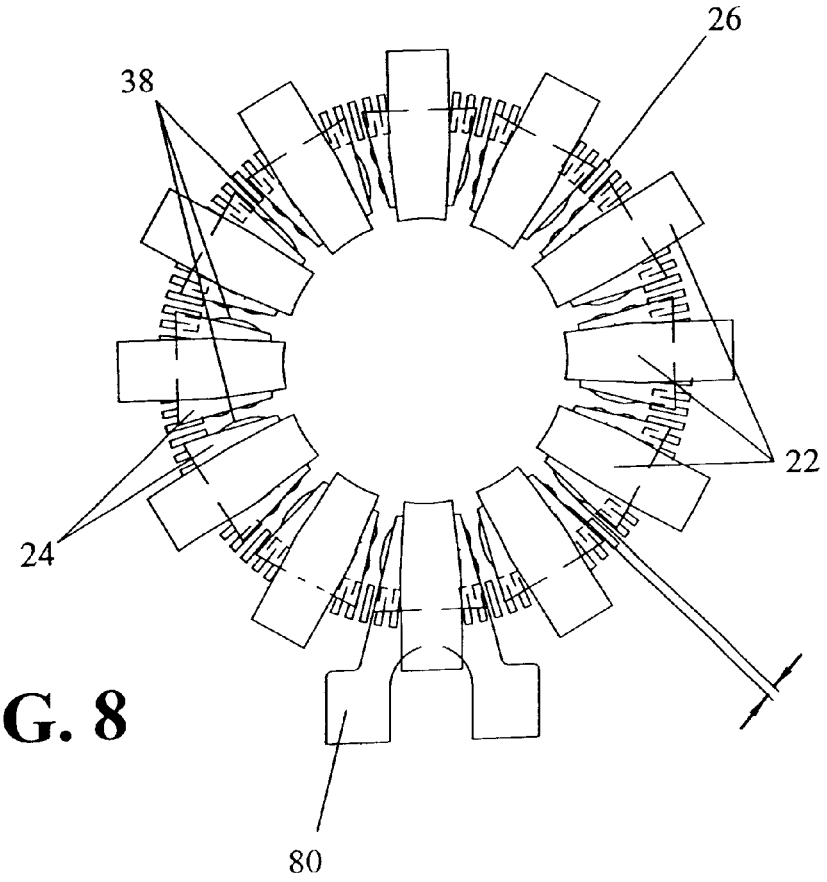

In order to fit as many chill elements as possible around a beverage container, the keystone spacers 24 are tapered outward from the array center, which reduces the distance between chill elements in the tubular array. The spacers 24 are preferably made of plastic or another material having a low rate of thermal conductivity, therefore discouraging water in the ambient air from condensing and freezing to form frost on the surface of the spacers. To avoid the problem of adjacent spacers 24 sticking to one another because of frost buildup, the contact surfaces of each spacer preferably have spherical bumps that reduce the actual contact area between them. As shown in FIG. 6, preferably these contact bumps include a large spherical node 38 centered on the contact surface of one spacer 24, and a pattern of four smaller spherical nodes 40 located on the corresponding contact surface of an adjacent spacer, as shown. The gap 42 between the four smaller nodes 40 is designed to receive the opposing large node 38 when the spacers 24 make contact, thus encouraging the spacers and their respective chill elements to be properly aligned. It is appreciated that a variety of other design options may be also be used that would effectively reduce the contact area between adjacent spacers. Additionally, each spacer 24 includes one slot 44 located along its back edge perpendicular to the tubular array. The slot 44 is designed to receive a coil spring 26 in the desired array retention configuration.

Each chill element 22 is generally rectangular in shape, but the inner surface 46, which is designed to make contact with a beverage container, is slightly arcuate to improve contact with a beverage container. The chill elements may be made in a multitude of different elongated shapes, and may have circular, square, hexagonal, or a variety of other shaped cross-sections. It is also appreciated that the beverage contact surface 46 of each chill element 22 could be formed to include various arcs, flats, wedges or other contours that would be complementary to and thus improve thermal contact with beverage containers having specific shapes.

Because the chill elements 22 are designed to surround a beverage container and to rapidly transfer heat from the container and the beverage retained therein into the hyper-chilled coolant flowing through the chill element 22, each chill element is preferably made of copper or another material having a high rate of thermal conductivity. It is appreciated that the chill elements and other components of the cooler, depending on the temperatures involved, may also be made from materials such as tantalum or titanium-based alloys that retain high ductility at low temperatures.

Each chill element 22 is hollow having a chill fluid feed port 48 and a chill fluid return port 50. Each feed port 40 is designed to receive an individual feed line 52, which line is flexible to allow the chill element 22 to radially expand away from or toward the tubular array center axis in order to accommodate different size beverage containers. Each feed line 52 is preferably made of polyethylene or other thermoplastic material that remains flexible at very cold temperatures, but may be made of thin-walled metal tubing, metal braid tubing combined with thermoplastic tubing, or the like. Each return port is designed to receive an individual return line 54 that directs the coolant back to an insulated reservoir. The individual return lines 54 are similar in construction to the feed lines 52, likewise being flexible to allow for expansion and contraction of the tubular array 32.

Figure 3:
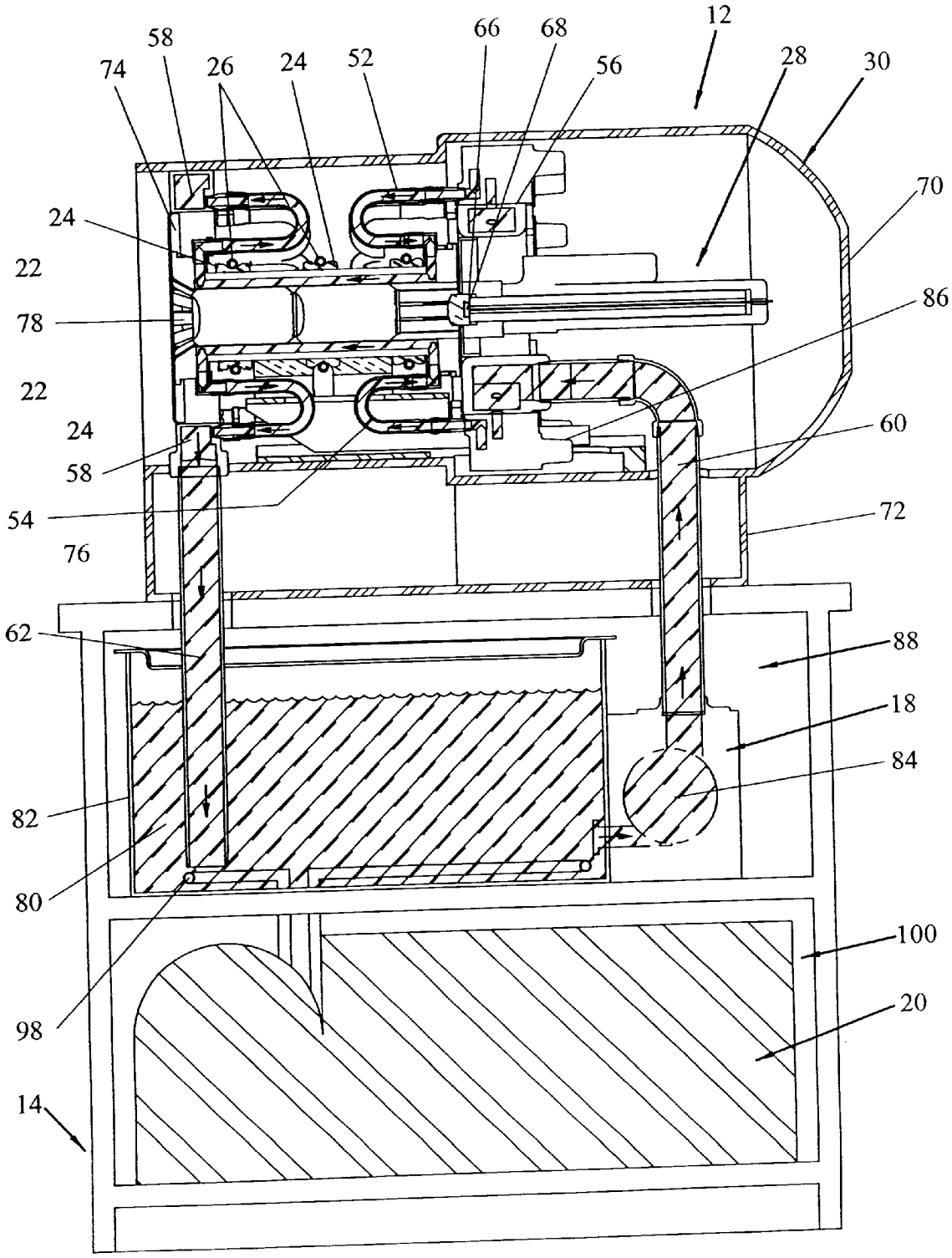
FIG. 3 is a side cutaway view of the FIG. 1 cooling unit, taken along line 3—3 of FIG. 1, illustrating circulation of the hyper-chilled coolant from the insulated reservoir, through the pump, up the main feed line, through the barrel chiller including chill elements, and back into the insulated reservoir through the return line, and also illustrating an evaporator of the refrigeration circuit within the bottom portion of the insulated reservoir.
Figure 4:
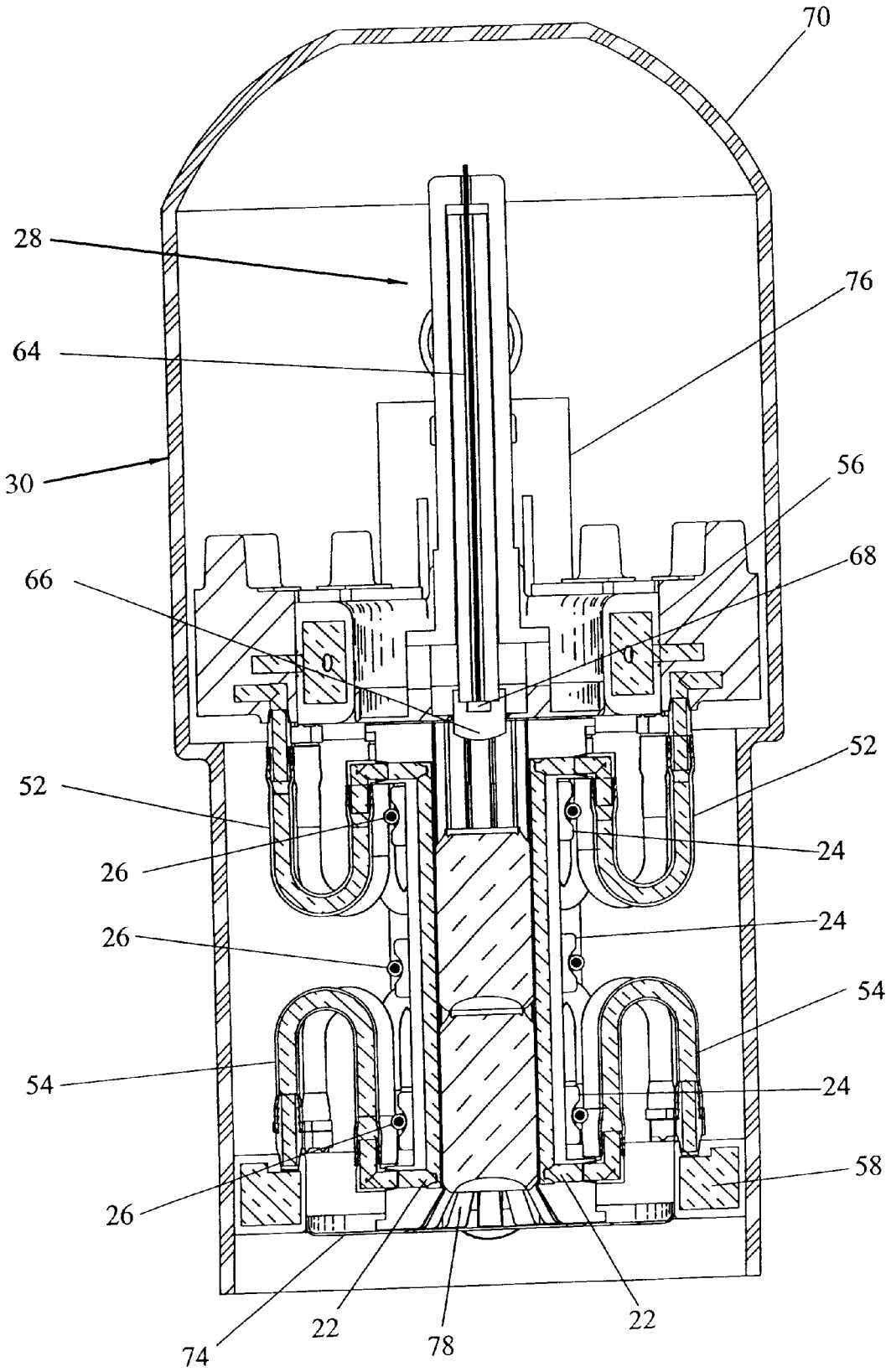
FIG. 4 is an enlarged cross-sectional top view of the barrel chiller portion of the FIG. 1 cooling unit, taken along line 4—4 of FIG. 1, showing in greater detail the components of the barrel chiller, and illustrating the cooling of two standard 12-ounce beverage containers having thin aluminum walls.
Figure 5:
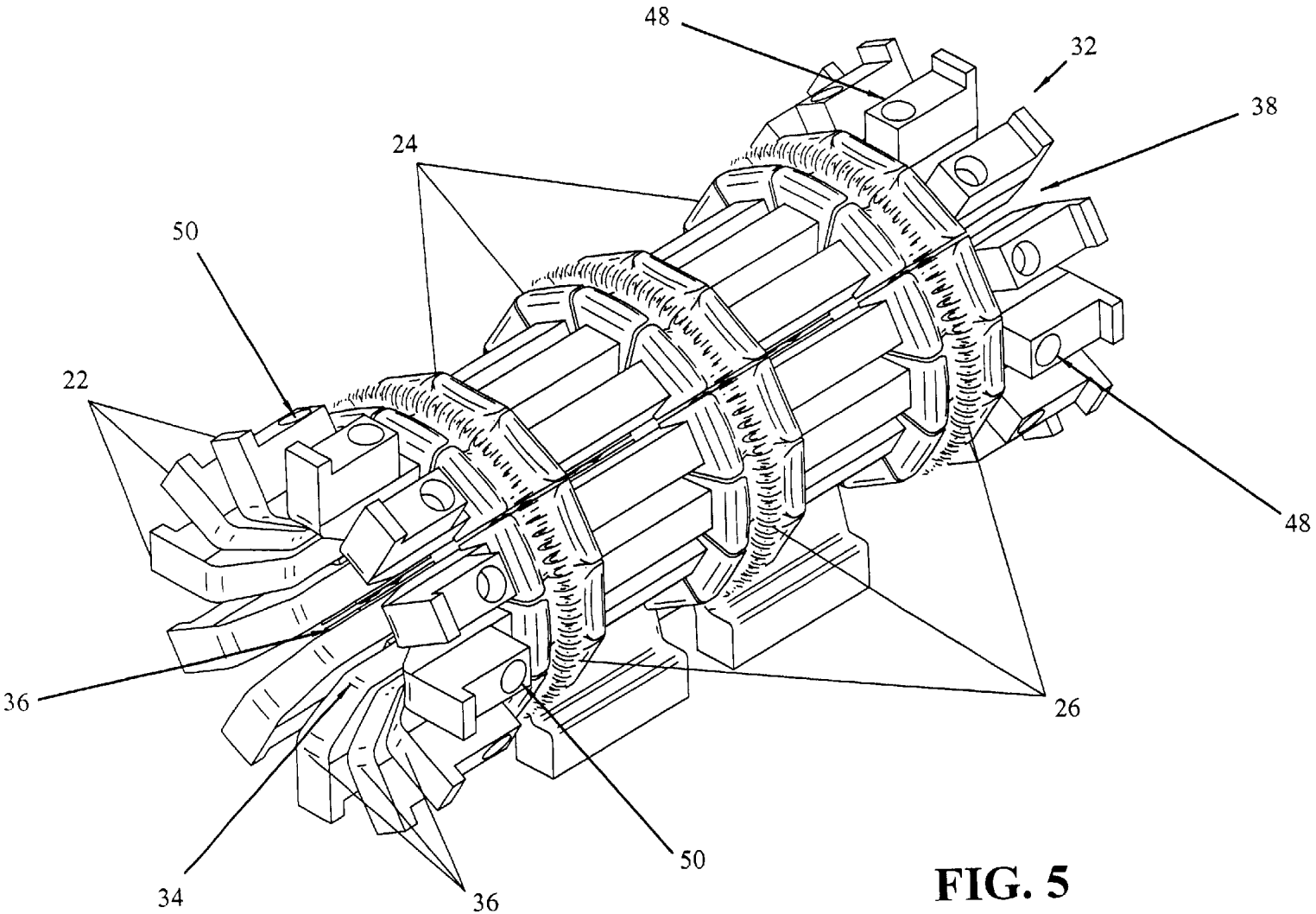
FIG. 5 is a front perspective view (shown in isolation) of the chill element array portion of the barrel chiller of the cooling unit in FIG. 1.

With particular attention to FIGS. 3 and 4, the barrel chiller 12 in accordance with the first embodiment further includes an annular feed manifold 54 and an annular return manifold 58. Each chill element feed line 52 is connected at a first end to the annular feed manifold 56 and terminates at a second end to the respective chill element 22. The annular feed manifold 56 preferably connects to each chill element feed line 52 along one annular face, and to the main feed line 60 of the coolant circuit along its opposing annular face. Additionally, the annular feed manifold is hollow, being generally toroidal in shape, and acts like a header to allow coolant to flow from the attached main feed line 60 into each of the attached chill element feed lines 52. Preferably the feed manifold 56 is made of steel or like metal, but may be made of a thermoplastic material or the like capable of handling the low temperatures of a hyper-chilled coolant.

The return port 50 of each chill element 22 is attached to a chill element return line 54 similar in design and construction to the chill element feed lines 52, which returns coolant from the respective chill element 22 to the annular return manifold 58. The annular return manifold 58 is similar in design and construction to the annular feed manifold 56. It attaches to each chill element return line on one annular face thereof, and preferably attaches to the coolant return line 62 along a bottom portion thereof. As with the annular feed manifold 54, the annular return manifold 58 acts as a header to divert coolant circulated from the individual chill elements 22 into a single return line 62 back to a coolant reservoir.

The barrel chiller 12 also includes an ejection device 28 to assist in removing a beverage container from the chill element array cavity 36 after completion of the cooling cycle. The ejection device preferably consists of a ram 64 coaxially positioned along the axis of the chill element array 32, located at the back end 38 of the array 32. The ram 64 is adapted to urge a container or a plurality of containers retained within the chill element array cavity 36 out of the front end 34 of the array. The ram 64 may be pneumatically, hydraulically, electrically, manually or otherwise operated according to known technologies. The ram 64 preferably includes an ejection bumper 66 located at the end of the ram 64 cushion the interface between the ram 64 and a beverage container as a container is urged out of the chill element array 32. The ram 64 also preferably includes a load sensor 68 located on the end thereof between the ejection bumper 66 and the tip of the ram, wherein force on the tip of the ram 64 may be sensed and the force information sent to the controller 16 through load sensor leads. The addition of a load sensor 68 allows the controller 16 to ensure the ejection force of the ram 64 is kept below a safe level and to notify the operator if a beverage container or other object is jammed in the tubular barrel chiller array 32.

Furthermore, the barrel chiller 12 includes a housing 30 which supports the chill element array 32 and the ejection device 28, and which connects the barrel chiller 12 to the system enclosure 14. The housing 30 according to the first embodiment supports the barrel chiller 12 in a fixed configuration, but it may alternatively allow the barrel chiller to pivot for improved access or for orienting a beverage container in order to enhance natural convection currents within the beverage that aid in the cooling process. Additionally, the housing 30 may be designed to rotate the beverage horizontally, vertically, or in a combination thereof during the cooling process to mechanically mix the beverage and thereby improve the cooling process.

As shown in FIGS. 3 and 4, the barrel chiller housing 30 according to the first embodiment includes an insulated housing 70, a fixed support structure 72, a front retainer plate 74, a rear retainer plate 76, and a beverage insertion guide 78. The fixed support structure 72 shown in FIG. 3 fixedly attaches the barrel chiller 12 to the enclosure. The insulated housing 70, which houses the barrel chiller components, is attached to the support structure. The keystone mounting spacer 80 (detailed in FIG. 6), which supports the tubular chill element array 32, attaches to the base of the insulated housing.

The front retainer plate 74, which retains the tubular array and keeps it from moving forward as a beverage container is ejected, is connected along the front portion of the insulated housing. The front retainer plate 74 preferably includes a beverage insertion guide that serves, in conjunction with the bevels 36 of the tubular array, as a means for expanding the tubular chill element array 32 according to the size of the beverage container being inserted.

The rear retainer plate 76, which retains the aft position of the tubular array 32 and keeps it from moving rearward as a beverage container is inserted, is connected along the mid-portion of the insulated housing 70. The annular feed manifold 56 and ejection device 28 are preferably connected to the rear retainer plate 76.

The Hyper-chilled Coolant Circuit

Figure 9:
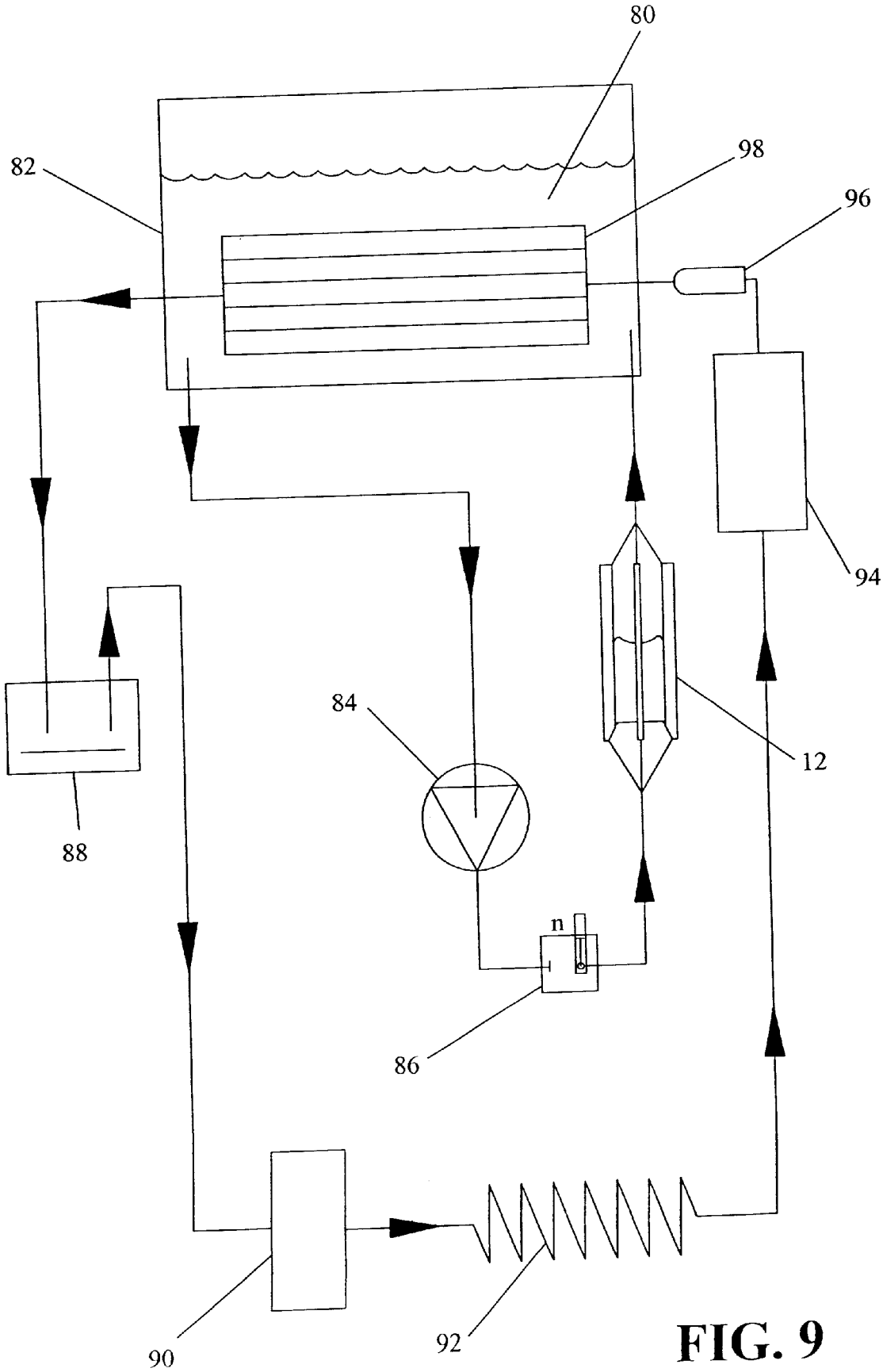
FIG. 9 is a schematic diagram of the coolant circuit and refrigeration circuit of the FIG. 1 cooling unit.

This circuit 18 in accordance with the first embodiment, as diagramed in FIG. 9 and shown in FIG. 3, includes a hyper-chilled liquid coolant 80, an insulated reservoir 82, a pump 84, a main feed 60 leading to the barrel chiller 12, a single solenoid valve 86, the barrel chiller 12, and a return line from the barrel chiller 62. The pump 84 and insulated reservoir 82 are preferably located within the upper recess enclosure 88 of the system enclosure 14, below the barrel chiller 12. During a cooling cycle, the pump 84 propels coolant 80 from the insulated reservoir 82 where coolant is stored in a hyper-chilled state, up the main feed line 60 into and through the barrel chiller 12, and from the barrel chiller back into the insulated reservoir 82 through the return line. The pump 84 and single solenoid valve 84 are in electrical communication with and are directed by the controller 16. The pump 84 preferably has variable options to allow for different flow rates depending on the cooling cycle selected by the controller 16.

The single solenoid valve 86 in this embodiment is attached to the annular feed manifold 56 and is able to open, close, and partially open to restrict flow of the coolant through the barrel chiller 12. By directing operation of the pump and the solenoid valve, the controller 16 is able to completely control the flow rate of the coolant 80. This embodiment does not allow for selective control of individual chill elements. However, it should be appreciated that the barrel chiller design allows for selective flow through each element simply with the addition of selectively operable valves or other flow control mechanisms along the flow path of each individual chill element. The selectively operable valves may include a separate solenoid valve along the flow path of each individual chill element that can be directed by the controller. Alternatively, the selectively operable valves may include mechanically operated or manually operated gate valves, butterfly valves, or the like.

Although only the reservoir has been explicitly referred to as "insulated," it is appreciated that most portions of the coolant circuit 18, as well as many parts of the barrel chiller 12 and refrigeration circuit 20 are insulated to reduce heat gain into the system.

The Refrigeration Circuit

The refrigeration circuit is diagramed in FIG. 9 and represented in FIG. 3, includes an accumulator 88, a compressor 90, a condenser 92, a filter dryer 94, an expansion valve 96, and an evaporator 98. The accumulator 88, compressor 90, condenser 92, filter dryer 94, and expansion valve 96 are preferably located within the lower recess enclosure 100. The evaporator 98 is preferably located within the hyper-chilled coolant reservoir 82. The refrigeration circuit operates as a standard refrigeration cycle to remove heat from the coolant stored within the hyper-chilled coolant reservoir 82. Because this invention is designed to rapidly cool a beverage stored within a beverage container, the refrigerant (not shown) is preferably a conventional fluid that is able to cool the coolant 80 down to very cold temperatures such as −30° F., −45° F., −60° F. or even −80° F. or colder. For the first and second temperatures just named, ethylene glycol/water or propylene glycol liquids may be utilized.

The Controller

Controller 16 is also located on top of the system enclosure 14, as shown in FIGS. 1 and 2, and includes a display unit 15, a central processing unit (CPU) (not shown), random access memory (RAM) (not shown), read-only memory (ROM) (not shown), at least one stored program, display readouts 17, at least one input module 19, and sensors (not shown). In general, the controller 16 is adapted to receive operational inputs from the operator through the input module 19, as well as from sensors (not shown) located throughout the unit, and to control the cooling cycle based upon the inputs received.

The display unit 15 is the visible portion of the controller 16 and, as shown in FIGS. 1 and 2, is preferably attached to the side of the barrel chiller 12. It may, however, be attached to the enclosure or located at any other position visible and accessible by the operator. The display unit preferably houses the display readouts 19, input module 17, CPU, RAM, and ROM, as well as any programs stored in the RAM or ROM. The display readouts preferably include a plurality of signal lights and an LED readout, but may also include a liquid crystal display (LCD) panel, a plurality of subpanels, or the like. The display panel signal light outputs preferably include the following: a "chilling in progress" indicator, a "determining container material" indicator, a "reading insertion temperature" indicator, an "approximating container volume" indicator, an "error readout," and a "stop" process interrupted indicator. The LED readout preferably includes a "time remaining" readout, but may also include a "current temperature" readout, a "time remaining" readout, a "final temperature" readout, operator instructions such as "please select a certain entry option," or the like.

Figure 10:
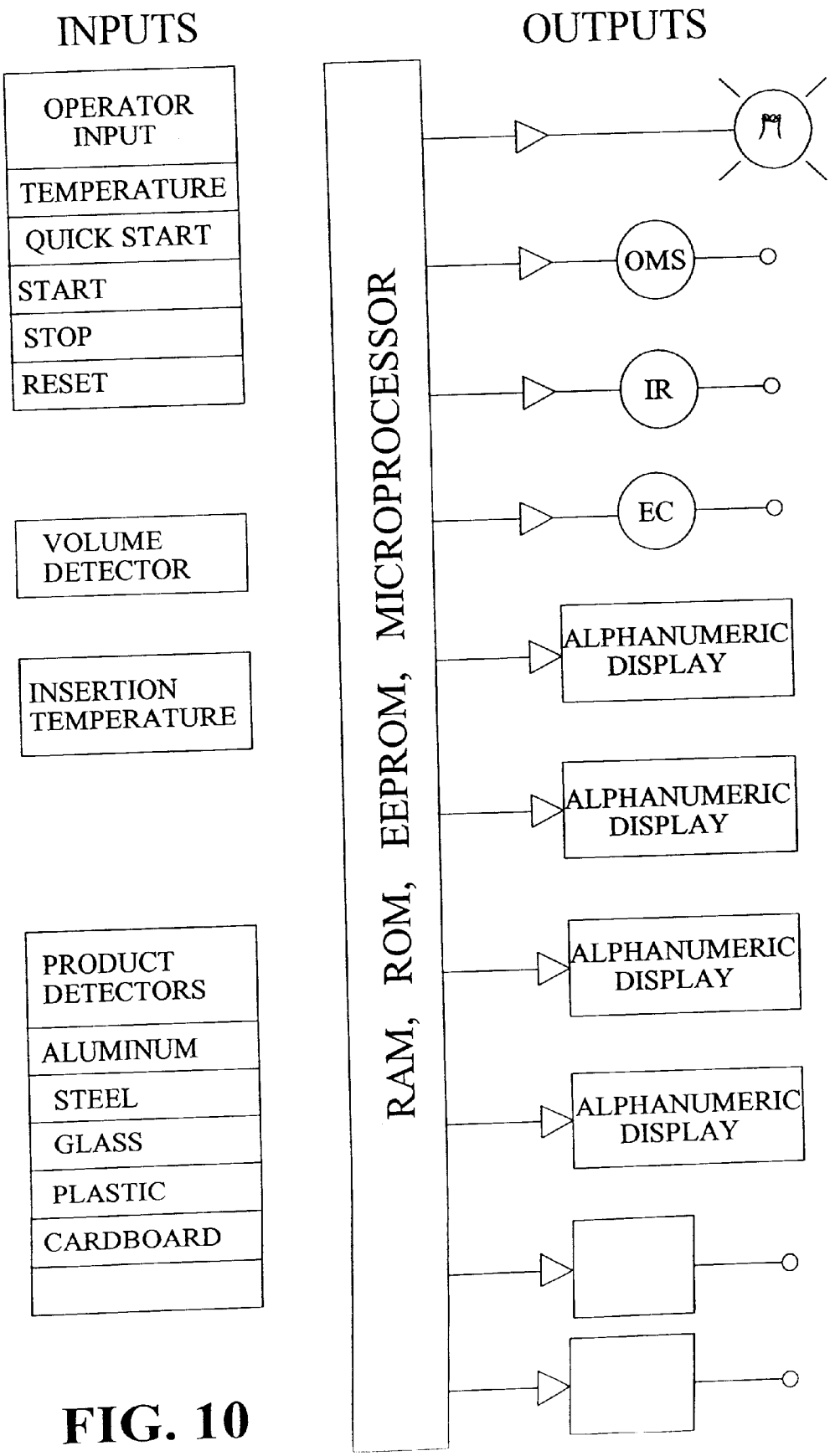
FIG. 10 is a simplified block diagram of one possible electronic controller for use with the FIG. 1 embodiment, showing a microcomputer and various inputs shown connected on the left side and various outputs shown connected on the right side.

The input module preferably includes a keypad array having alphanumeric entry switches as well as other entry switches, such as selections for the type of beverage container to be cooled, the desired cooling cycle, and other options. Although the input module 17 and the display readouts 19 are separate entities in this embodiment, it is appreciated that they could be combined using a touch screen or other input/output device. With particular reference to FIG. 10, operator inputs may include information such as the beverage temperature (if known), and operation requirements, such as length of the cooling cycle desired. Preferably, these inputs resemble the control panels commonly found on microwave ovens and the like, but may be as simple as stop and start buttons.

The CPU, RAM, ROM, and program act in concert to evaluate the inputs received and to control the cooling process. The CPU and RAM may be specially manufactured for this invention, or may preferably make us of off-the-shelf items available at the time of manufacture. The ROM may also be specially designed for this invention and may include program instructions. However, PROMs, EPROMs, EEPROMs or the like are preferred, which allow for selective programming, and may be arranged to be programmed even in the field. The RAM is preferably used to temporarily store operator and system inputs, but may also be used to store programming instructions supplemental to the program or programs stored in the ROM. Based on the programming instructions from the ROM or other memory source and the inputs received, the CPU sends outputs to the display panel, as well as to outputs that control various cooling unit components.

The sensors (not shown) located throughout the unit 10 may be related to safety considerations, and may accordingly sense whether a beverage container is completely inserted, whether the object inserted is actually a beverage container or other appropriate object, or other safety considerations. The sensors also include a variety of operational sensors, such as temperature sensors to determine the initial temperature of the beverage, product sensors to determine the type of container inserted, volume sensors to determine the volume of beverage retained in the container or to calculate the approximate volume based on container size, sensors to determine the ambient conditions of the environment, orientation sensors (see Second Embodiment) to determine the location and orientation of the barrel chill array, and various other sensors to aid the controller in determining and controlling the appropriate cooling cycle.

The System Enclosure

System enclosure 14 preferably supports and houses all components, pertinent controls, and electronic mechanisms for the cooling unit. For storing components of the coolant circuit 18 and the refrigeration circuit 20, the enclosure 14 preferably has an upper 88 and a lower internal recess enclosure 100. The system enclosure 14, is preferably in the following range of sizes. The width, that is, the horizontal distance across the front of the unit, may be in the range of about 15 inches to about 36 inches, with a range of about 18 inches to about 30 inches being preferred, and with a range of 20 inches to 25 inches been most preferred. The height of the unit, that is, the vertical distance from the bottom to the top surface of the unit's enclosure, may be in the range of about 20 inches to about 36 inches high, with a range of about 25 inches to about 30 inches being preferred. The depth of the unit, that is, the horizontal distance from the front surface to the back or rear surface, may be in the range from about to about 30 inches, with a range of about 10 inches to about 25 inches being preferred that, and a range of about 12 inches to about 20 inches been most preferred.

Operation of the Cooling Unit

When the cooling unit is first powered up, the microprocessor runs an initialization routine to ensure that all switches, sensors and other control devices are operational, and ready to run. This initialization routine checks each switch, sensor and detector to make sure that it is in its off position when it should be off, and then, later in the routine, also looks at each switch, sensor or detector that can be turned on during this power-up routine that can be energized or actuated to make sure that it is on when it should be on. With regard to the product sensors, to make sure that each product sensor is in a proper state. The controller 16, upon detecting a fault condition during this start-up test, will display an appropriate fault code. The fault code is thereafter displayed on the flat panel alphanumeric display on the front face of the operator control panel.

Other than startup of the unit, the operation of the chill element cooling system 10 generally includes the following steps: installing a beverage container or containers, selecting control options, cooling the beverage and beverage container, removing the beverage container, and continually maintaining the coolant 80 in a hyper-chilled state. Installing a beverage container begins the process for the consumer/operator and is designed to be as simple as possible. It is noted, however, that selecting the control options could just as easily be arranged to be the first step for the operator.

To aid installation, the chill elements 22 and the housing 30 preferably include means for expanding the tubular chill element array according to the size of the beverage container being inserted. The expansion means preferably includes bevels 36 on the front ends of the chill elements 22 to force the elements apart as the container is installed and angled beverage insertion guides 78 attached to the front opening of the housing 30 that also serve to expand the chill elements as a beverage container is inserted, or other expansion means that one skilled in the art may recognize such as electrical, pneumatic, hydraulic, or other mechanical expansion means.

An optional means of installing the beverage container includes the addition of power rollers or other means to mechanically feed and eject beverage containers from the barrel chiller 12. The feed mechanism preferably includes a plurality of mechanically driven rollers, but may include belts or other means to mechanically convey a beverage container from the mouth of the barrel chiller into the tubular array. Preferably, the feed mechanism is activated by the controller 16 when a beverage container is sensed within the front opening to the barrel chiller 12.

Once a beverage container or a series of smaller like containers are installed, the operator preferably selects various control options according to the cooling process desired. Such inputs may include designation of the cooling cycle duration, the type of cycle preferred, the type of container installed, the type of beverage within the container, or a host of other conceivable options. Alternatively, the cooling unit 10 may be designed to automatically start the process upon insertion of a beverage container. In either case, it is desirable that the controller also receives input from various other sensors (not shown) located throughout the cooling system and adjusts the cooling cycle accordingly.

Cooling the beverage proceeds according to the outputs from the controller 16. The controller 16 starts the cooling process by signaling the coolant pump 84 to begin operation. The coolant pump 84 propels hyper-chilled coolant 80 stored in the insulated reservoir 82 through the coolant circuit 18, which includes sending the coolant 80 through each of the individual feed lines 52, their respective chill elements 22, the associated individual return line 62, and back to the insulated reservoir 82. Cooling occurs as heat is conducted through the beverage container and the chill elements 22 into the hyper-chilled coolant 80, which carries the heat into the insulated reservoir 82. The heat is then removed from the insulated reservoir by the refrigeration circuit 20.

As an option to further reduce the cooling cycle time, thermoelectric materials may be used. When an electrical current flows through a thermoelectric material, one end of the material is heated while the other is cooled. Accordingly, chill elements 22 that include thermoelectric materials may greatly improve the movement of thermal energy from the beverage container contact surface of the chill element to the portion of the chill element through which the coolant flows. By improving the thermal conductivity of chill elements 22 with the use of thermoelectric materials, the coolant can flow at a reduced rate or may be kept at a warmer temperature without sacrificing the cooling cycle time of the cooling system.

At the end of the cooling cycle, removing the beverage container from the barrel chiller 12 is preferably accomplished through the use of the ejection device 28. The ejection device 28 may be manually activated or automatically activated by the controller 16 at the end of the cooling cycle. Preferably, the ejection device 28 pushes the beverage container(s) partially out through the front of the barrel chiller such that an end of the container is exposed outside of the housing. The operator may then safely extract an exposed container the rest of the way out of the barrel chiller 12 without reaching into the barrel chiller or without the beverage container falling out of the barrel chiller.

Maintaining the coolant in a hyper-chilled state technically is not a step in the cooling cycle, but is an important step that is periodically occurring in preparation for and perhaps during cooling cycles. Preferably, the controller 16 constantly monitors the temperature of the insulated reservoir 82 and cycles the refrigeration circuit 18 on and off accordingly. Depending on the anticipated use of the cooling unit, the size of the insulated reservoir 82, the anticipated ambient conditions, the steady state heat gain of the coolant, and other factors, the refrigeration circuit 18 may be sized to be quite small such that it frequently cycles on, or to be larger such that it rarely cycles on.

The operation and design of the present invention provides many advantages over the prior art in cooling a beverage stored in a closed container. The prior art tends to cycle refrigerant around a beverage or a beverage container in serial flow, typically in a spiral configuration. In contrast, the present invention provides for parallel flow of the cooling fluid. The parallel flow design with individual cooling elements allows the cooling unit to be flexible and to accommodate various shapes and sizes of beverage containers. It also allows the controller to alter the cooling process by selectively turning different chill elements on or off as necessary to accomplish a desired cooling rate, to induce natural convective cooling currents in the beverage, or for other reasons. The chill elements 22 may be selectively turned on or off by use of electrical solenoid shut-off valves at the coolant inlet or outlet portions of the selected chill element.

Additionally, the use of a separate coolant circuit and refrigeration circuit can greatly reduce the cooling time of a closed-loop cooling unit. This is because such a unit can use a much smaller refrigeration unit than is required to cycle refrigerant at cryogenic temperatures through a similar unit having only a refrigeration circuit. It requires less refrigeration capacity to maintain a coolant stored within an insulated reservoir at very low temperatures than it does to produce sufficient refrigerant at such very low temperatures on demand to rapidly cool a beverage. The use of coolant at very low temperatures is important in order to produce the rapid cooling of this invention, because the heat transfer rate is proportional to the temperature difference between the coolant and the beverage.

Detailed Description of the Second Embodiment

Referring to FIGS. 11 through 14, there is shown a self-contained closed-loop cooling unit and method for carrying out chill element cooling tasks in accordance with a second embodiment of the present invention. The second embodiment includes all aspects and preferences of the first embodiment except as specified herein. Particularly, the second embodiment is a self-contained closed-loop cooling unit 110 that differs from the first embodiment by including a barrel chiller 112 pivotally connected to the enclosure 114, a flexible return line 162, a flexible feed line 160, a slightly different barrel chiller 112 design, and a manual ejector 128.

The barrel chiller housing 130 of the second embodiment includes a pivoting support structure 172 rather than a fixed support structure. The pivoting support structure 172 further includes a pivot actuator 173 connected between the insulated housing 170 and the base 175 of the support structure 172. The pivot actuator 173 serves to selectively adjust the desired vertical angular rotation of the barrel chiller 112 about the enclosure 114. The pivot actuator 173 may be pneumatically, hydraulically, electrically, manually or otherwise operated according to known technologies. Preferably, the controller 116 directs the pivot actuator 173 and thereby controls the angular orientation of the barrel chiller 112. Accordingly, the controller 116 may oscillate the angular orientation of the barrel chiller 112 during the cooling cycle to mechanically mix a beverage, to help induce convection currents within a beverage, or to otherwise affect the cooling process.

Figure 11:
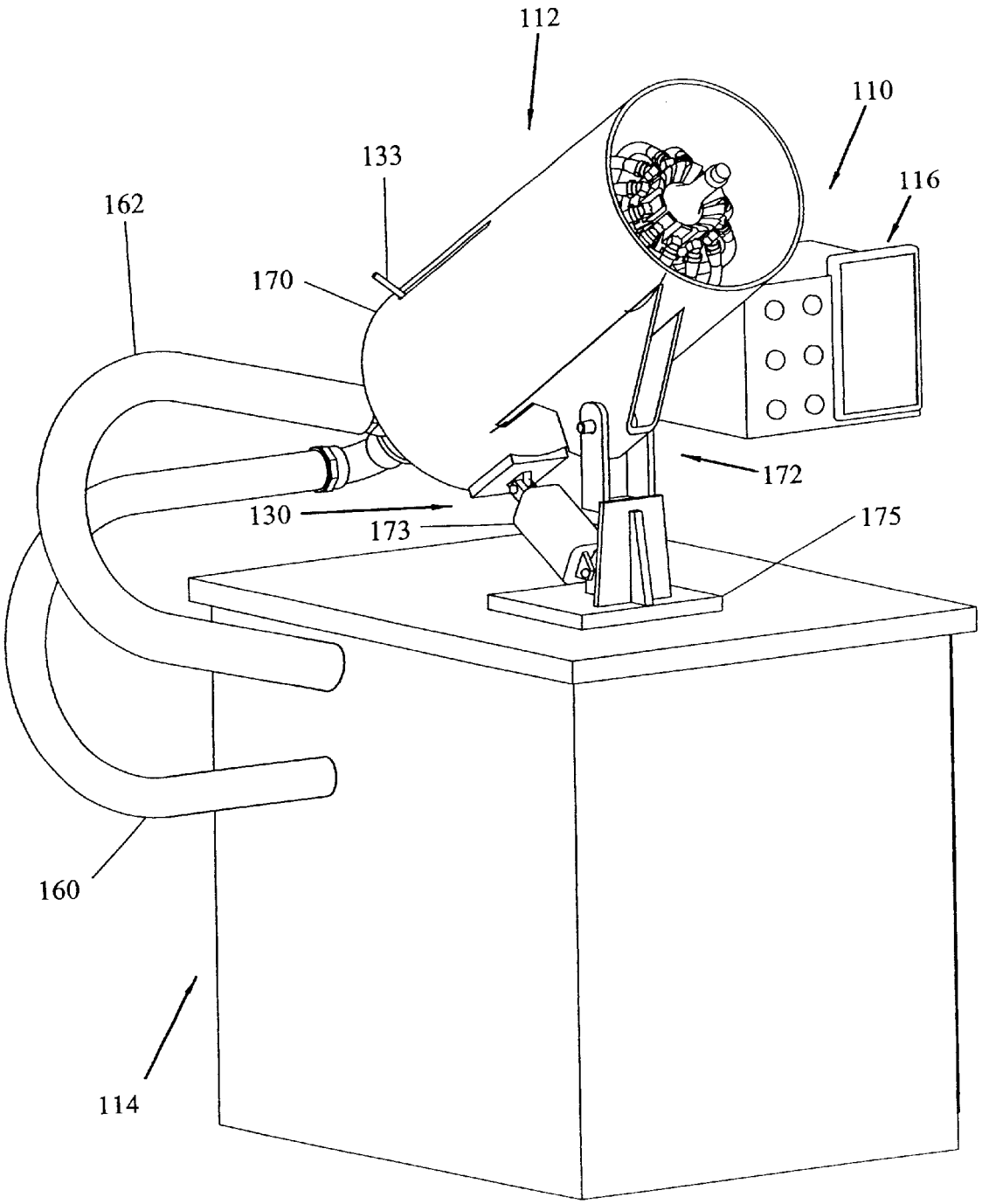
FIG. 11 illustrates, from a front perspective view, a second embodiment of the self-contained closed-loop cooling unit of the present invention, which shows the barrel chiller portion of the invention in this embodiment pivotally connected to the enclosure, and the controller attached to the barrel chiller housing on the right side thereof.
Figure 12:
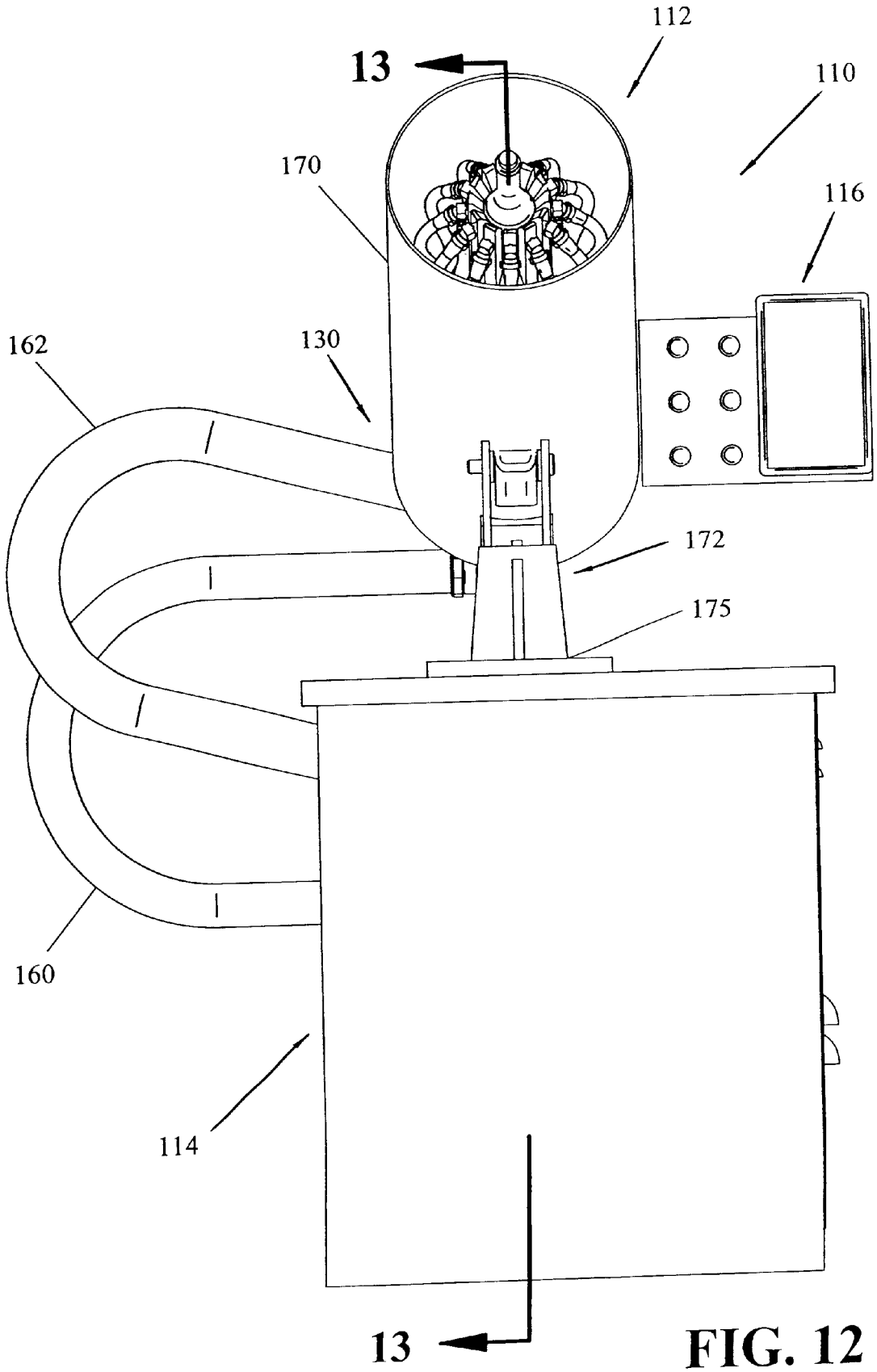
FIG. 12 is a front view of the cooling unit in FIG. 11.

The feed 160 and return lines 162 according to the second embodiment are flexible to allow for angular rotation of the barrel chiller 112. As shown in FIGS. 11 and 12, they are preferably oriented perpendicularly away from the rear of the barrel chiller 112 and loop around down into the enclosure 114 to attach to the coolant reservoir. The feed 160 and return lines 162 are preferably made of a thermoplastic material capable of withstanding very low temperatures, but may be made of flexible metal tubing, wire braid tubing, or other suitable material.

Figure 13:
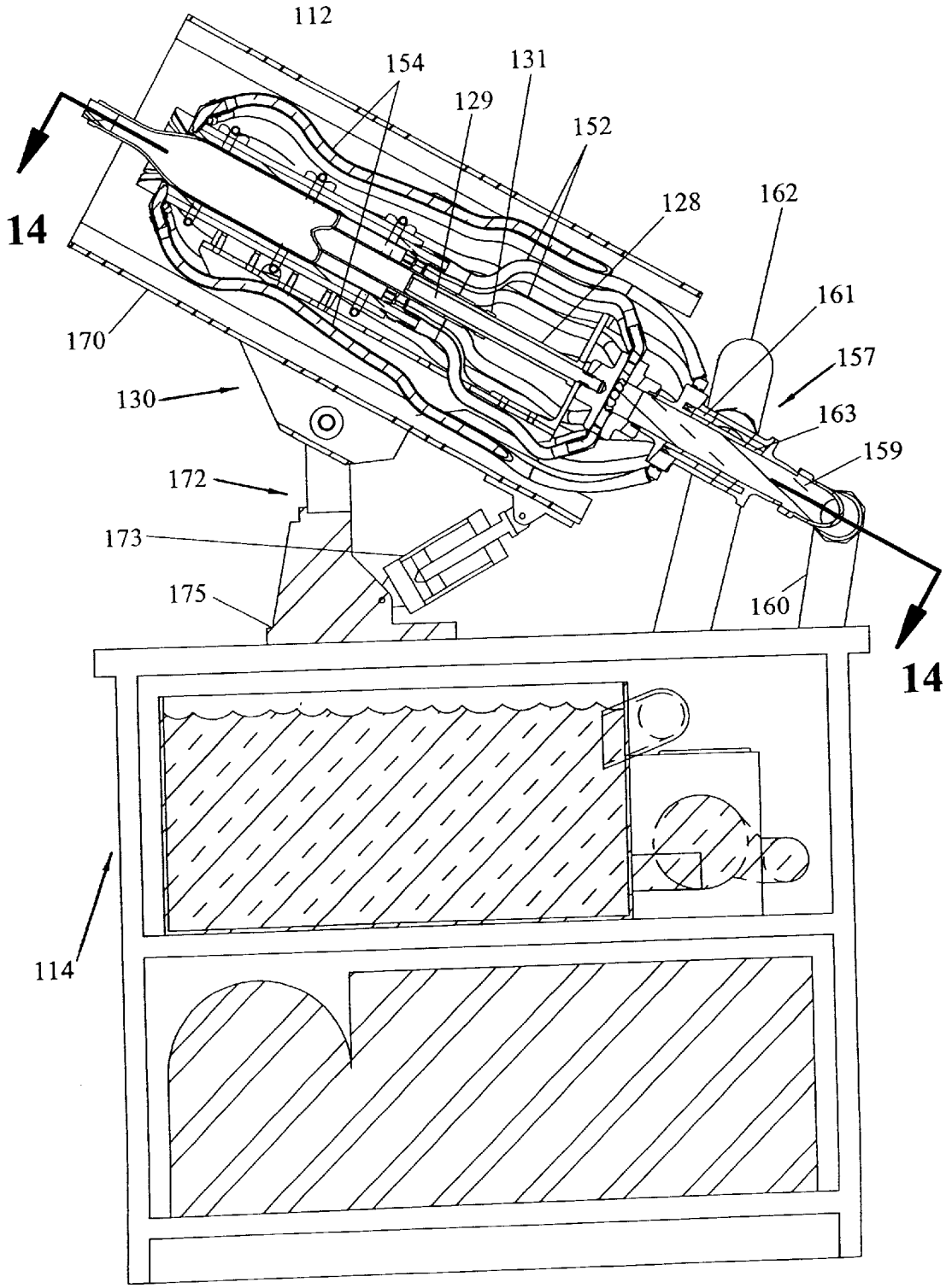
FIG. 13 is a side cutaway view of the FIG. 11 cooling unit, taken along line 13—13 of FIG. 11, showing the chill element array of the barrel chiller, portions of the coolant circuit primarily located within the center portion of the enclosure, and portions of the refrigeration circuit located primarily within the lower portion of the enclosure.
Figure 14:
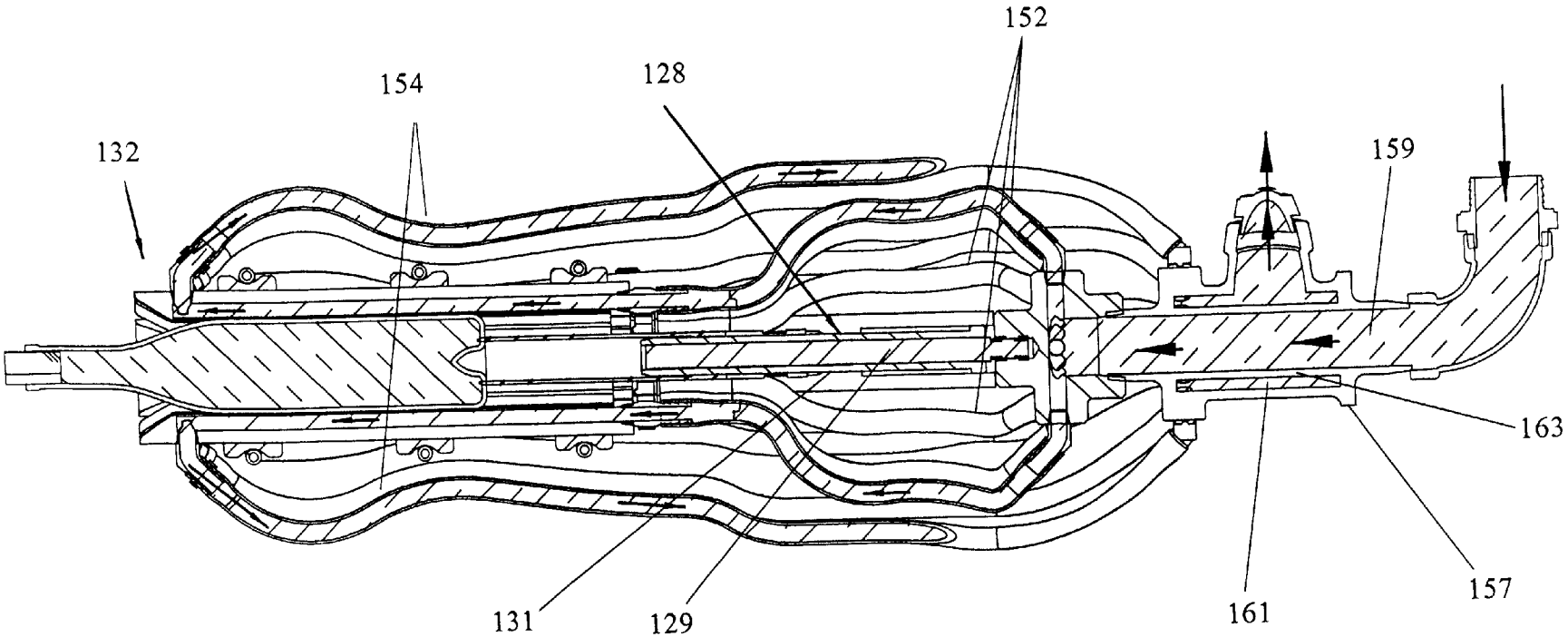
FIG. 14 is an enlarged cross-sectional top view (shown in isolation) of the barrel chiller portion of the FIG. 11 cooling unit, taken along line 14—14 of FIG. 13, which shows in greater detail the components of the barrel chiller according to the second embodiment, and illustrates the use of the cooling system to cool a bottle-type beverage container, which may be made of glass or plastic.

With particular reference to FIGS. 13 and 14, the second embodiment includes a slightly different barrel chiller 112 design than the first embodiment. In order to allow for a large range of angular rotation, both the coolant feed lines 160 and return lines 162 are preferably connected to the barrel chiller 112 close to one another, and preferably as close to the point of rotation as possible. Accordingly, the barrel chiller of the second embodiment does not include annular manifolds, but alternatively includes a combination feed and return tee 157 that diverts the incoming coolant to separate flexible feed lines 152, and collects the returning coolant from individual flexible return lines 154. The tee 157 preferably includes a cylinder portion 159 surrounded by a toroid portion 161. The cylinder 159 allows incoming coolant to flow through the tee 157 to a set of radially connected feed lines 152, and the toroid connects to the radially connected return lines 154. The cylinder 159 and the toroid 161 are kept separate by a wall 163 within the tee 157, and a bib 165, 167 attaches to each for connecting to the main feed 160 and return lines 162. The tee 157 is preferably made of steel or other metal capable of remaining ductile at very low temperatures.

The ejection device 128 of the second embodiment is preferably a manual device. The ejection device preferably includes a pilot shaft 129 mounted coaxially to the chill element array 132 and surrounded by a slidable cylinder 131. The slidable cylinder 131 having a pair of ejection handles 133 (shown in FIG. 11) perpendicularly extending therefrom through slots in the insulated housing. The ejection device is operated by simply using the handle 133 to slide the slidable cylinder 131 forward along the pilot shaft 129 until it contacts a beverage container located within the chill element array 132 and urges it forward and out of the barrel chiller 112. The ejection device 128 is preferably made of steel, but may be made of almost any other structurally sound material.

The cooling unit 110 according to the second embodiment operates the same as the first embodiment, except that the controller 116 may pivotally orient the barrel chiller 112, and a beverage container must be manually ejected. Otherwise, all aspects and preferences of the first embodiment apply to the second.

Detailed Description of the Third Embodiment

Figure 15:
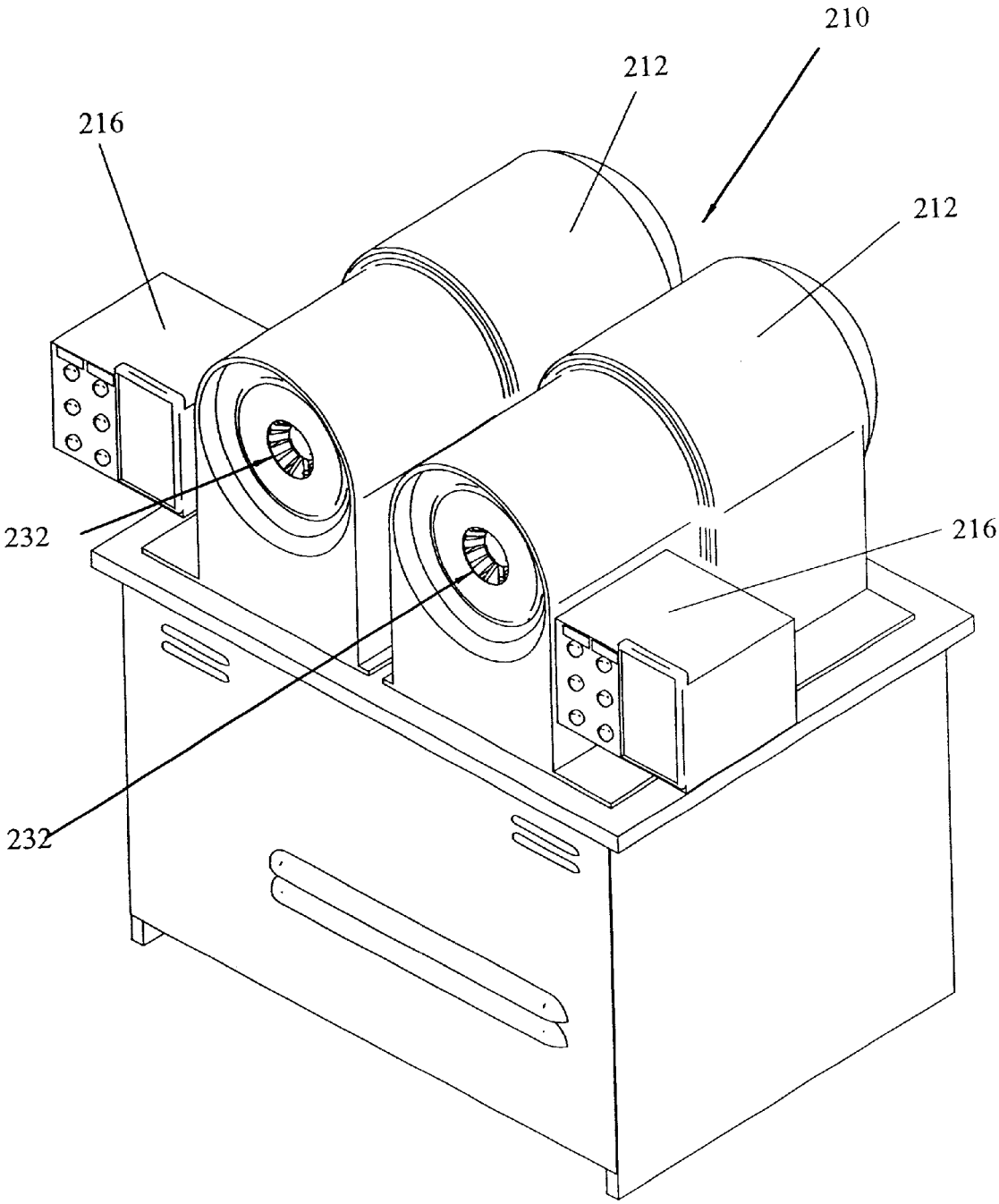
FIG. 15 is a front perspective view of a third embodiment of the self-contained closed-loop cooling unit of the present invention, showing a cooling unit having a pair of barrel chillers with corresponding controllers and operator interface panels.

Referring to FIG. 15, there is shown a self-contained closed-loop cooling unit and method for carrying out chill element cooling tasks in accordance with a third embodiment of the present invention. The third embodiment includes all aspects and preferences of the first embodiment except as specified herein. Particularly, the third embodiment is a self-contained closed loop cooling unit 210 that differs from the first embodiment by including a plurality of barrel chillers 212, and a plurality of controllers 216. This embodiment may be useful in a retail environment or similar environment where several persons desire to simultaneously use the rapid beverage cooler.

As shown, this embodiment preferably includes two barrel chillers, but may alternatively include three or more. Each of the barrel chillers 212 includes an independent tubular array 232, which are each fed coolant through a parallel branch of the coolant circuit (not shown). Alternatively, an individual coolant circuit may exist for each tubular array. This particular embodiment makes use of economies of scale by maintaining a single coolant reservoir of hyper-chilled coolant, a single refrigeration circuit, and a single enclosure, and yet being capable of simultaneously cooling several different beverage containers located within different tubular arrays.

As shown, this embodiment includes an individual controller 216 corresponding with each barrel chiller 212. Each controller 216 includes all aspects and preferences as detailed in the first embodiment, except the controllers may share some components, such as sensors to detect ambient environmental conditions for example. Alternatively, the individual controllers 216 may simply include a display unit and operator inputs, and one of the controllers, or even a central controller, may include the CPU, RAM, ROM, program instructions, and other components necessary to adequately control operation of the system.

Detailed Description of the Fourth Embodiment

Figure 16:
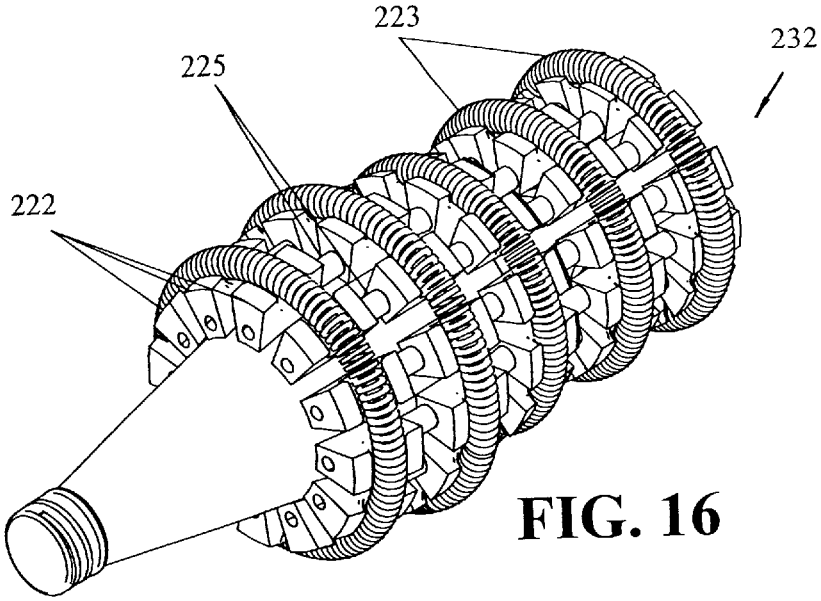
FIG. 16 illustrates, from a front perspective view, a fourth embodiment of the self-contained closed-loop cooling unit of the present invention, illustrating the segmented chill elements found in this tubular array portion of the barrel chiller.
Figure 17:
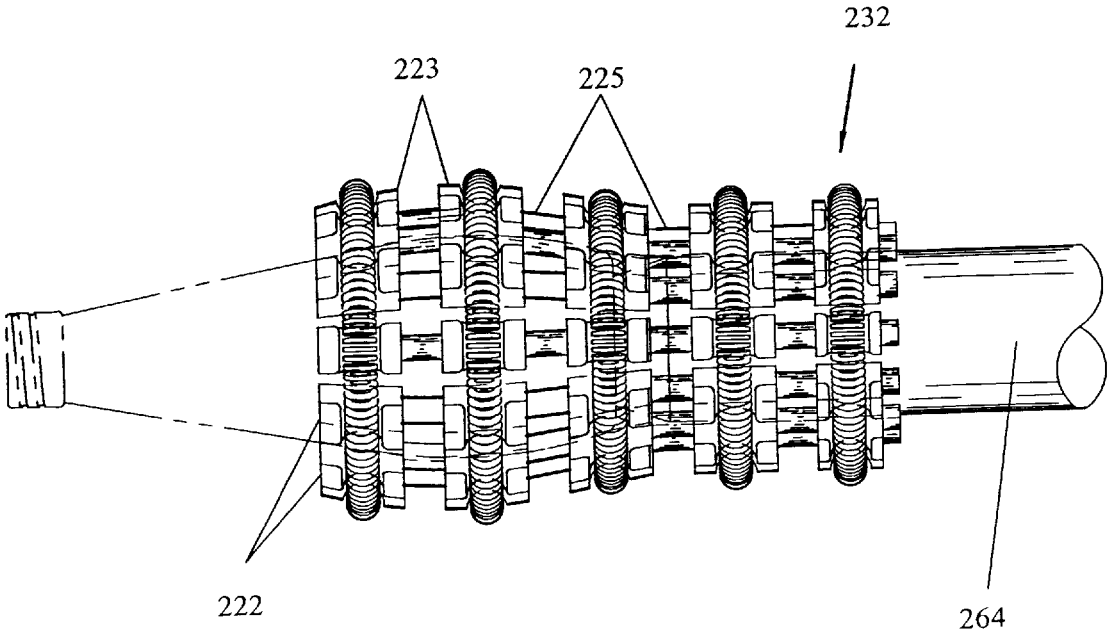
FIG. 17 is a side view of the segmented tubular array of the cooling unit in FIG. 16, specifically illustrating the ability of this segmented tubular array to conform to the periphery of a curvaceous bottle.

Referring to FIGS. 16 and 17, there is shown a self-contained closed-loop cooling unit and method for carrying out chill element cooling tasks in accordance with a fourth embodiment of the present invention. The fourth embodiment includes all aspects and preferences of the first embodiment except as specified herein. Particularly, the fourth embodiment is a self-contained closed-loop cooling unit (not shown) that differs from the first embodiment by including a segmented tubular array 232 having a plurality of segmented chill elements 222, and an ejection device (not shown) having a fully extensible ram 264. Each chill element 222 includes a plurality of hollow chill element segments 223 serially connected with a plurality of flexible tube segments 225. The chill segments 223 are preferably made from the same material as the chill elements in the first configuration, and the flexible tube segments 225 are likewise preferably made from the same material used for individual feed lines and return lines. Understandably, these materials must be able to withstand the very low temperatures of the hyper-chilled coolant, and the flexible tubing must remain reasonably flexible at those temperatures.

This embodiment is able to more fully accommodate beverage containers and similar sized items having irregular or non-uniform shapes. When a beverage container having an irregular shape is inserted into the tubular array 232, such as a juice bottle with a varying longitudinal cross-section, each individual chill element segment 223 orients tangentially parallel to the beverage container at the point of contact with the container. Each chill element segment 223 therefore may be oriented in a different plane from an adjacent chill element segment. Accordingly, each flexible tube segment 225 flexes to accommodate the different planar orientation of each chill element segment 223 attached to opposing ends of the tube segment 225.

The operation of cooling unit in this embodiment occurs the same way as in the first embodiment with the hyper chilled coolant flowing in parallel through the plurality of chill elements 222, but serially through the individual chill element segments 223 and connecting flexible tube segments 225 of a particular chill element, which act as a single chill element 222. The individual chill element segments 223 of each chill element 222 are able to better conform to the irregular shape than a solid chill element, thereby increasing the contact area between each element and the irregularly shaped container. The improved contact increases thermal conduction between the chill elements and a container, thereby resulting in a reduced cooling cycle for the beverage retained in an irregularly shaped container.

Additionally, the fully extensible ram 264 of this embodiment differs from the ram of the first embodiment in size and general operation. The fully extensible ram 264 is preferably circular in cross-section having a diameter equal to the smallest desired cross-sectional diameter of the tubular array 232. This design allows the ram 264 to retain the segmented tubular array 232 in a desired static configuration when a beverage container is not retained within the array, and allows for easy insertion of a beverage container prior to operation.

In the static position, the ram 264 is fully extended through the tubular array 232. As a container is inserted into the tubular array 232, the ram 264 correspondingly withdraws, thus allowing the individual chill element segments 232 to conform to the periphery of the container inserted therein. In order to assist retraction of the ram 264 during insertion, a load sensor is preferably attached to the beverage container contact portion of the ram, which allows the controller to direct retraction of the ram according to force applied to the ram by a beverage container inserted within the tubular array 232. At the end of a cooling cycle, the ram 264 extends to urge a container out of the tubular array, extending through the full length of the tubular array 232. As the ram urges a container out of the tubular array, the individual chill element segments 223 collapse around the ram 264 and are retained in the static configuration thereby.

The ram 264 is disclosed as the preferred method of retaining the segmented tubular array 232 in a static configuration. However, it is appreciated that the tubular array 232 may be designed to withdraw into a desired static configuration by other means, such as through the use of orienting spacers, orienting rods placed between each chill element, flexible tube segments 225 that only flex radially outward from the center of the tubular array, or the like.

Detailed Description of the Fifth Embodiment

Figure 18:
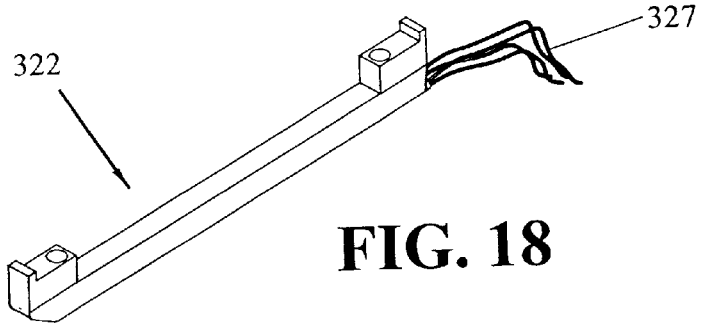
FIG. 18 illustrates, from a front perspective view, the key differences between a fifth embodiment of the self-contained closed-loop cooling unit of the present invention, and the FIG. 1 embodiment, namely the chill elements (one being shown in isolation in FIG. 18) having an elongated heating element embedded therein and closely coupled to and adjacent to the cooling surface of the chill element.
Figure 19:
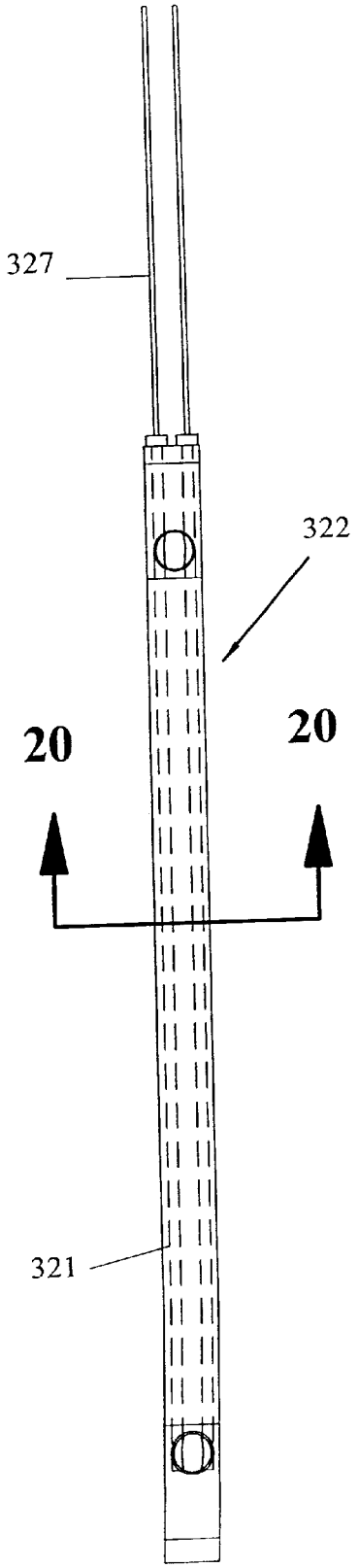
FIG. 19 is a top view of the chill element of FIG. 18.
Figure 20:
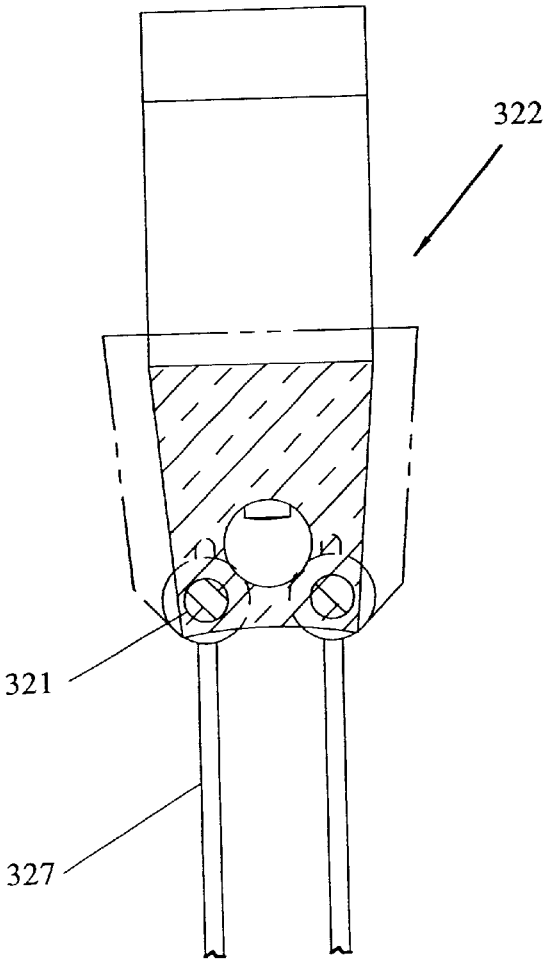
FIG. 20 is a sectional view of the chill element of FIG. 19.

Referring to FIGS. 18, 19, and 20, there is shown a self-contained closed-loop cooling unit and method for carrying out chill element cooling tasks in accordance with a fifth embodiment of the present invention. The fifth embodiment includes all aspects and preferences of the first embodiment except as specified herein. Particularly, the fifth embodiment is a self-contained closed-loop cooling unit (not shown) that differs from the first embodiment by including at least one heating element within one or more chill elements. Accordingly, a selectively heated chill element 322 includes an electrically activated heating element 327 imbedded within the chill element 322, and heating element leads 327 attached to the heating element 327.

Each heating element 321 is preferably made from a metal, metal alloy, or other electrically conductive material that produces heat as an electric current passes through it and that can withstand the very low temperatures associated with the hyper-cooled coolant during the cooling cycle. Each resistance heating element is elongated and preferably U-shaped such that both ends of the elongated heating element are in close proximity. Each heating element 321 is preferably imbedded within a chill element 322 such that both ends are located at the rear elongated portion of a chill element 322. The heating element leads 327 are connected to the elongated ends of a corresponding heating element 321.

Each heating element lead is preferably electrically connected to the controller (not shown), or a remote electric switch (not shown) directed by the controller. In operation, each heating element 321 is selectively activated by the controller at the end of the cooling cycle in order to briefly heat the corresponding chill element 322 and overcome any frost buildup between the chill element and the beverage container, or between the chill element and an adjacent chill element. Additionally, a heating element may be selectively activated in order to induce convection currents within the beverage during the cooling cycle, or to partially melt ice buildup within the beverage, preferably long enough to release the ice from the interior wall of the beverage container.

Detailed Description of the Sixth Embodiment

Figure 21:
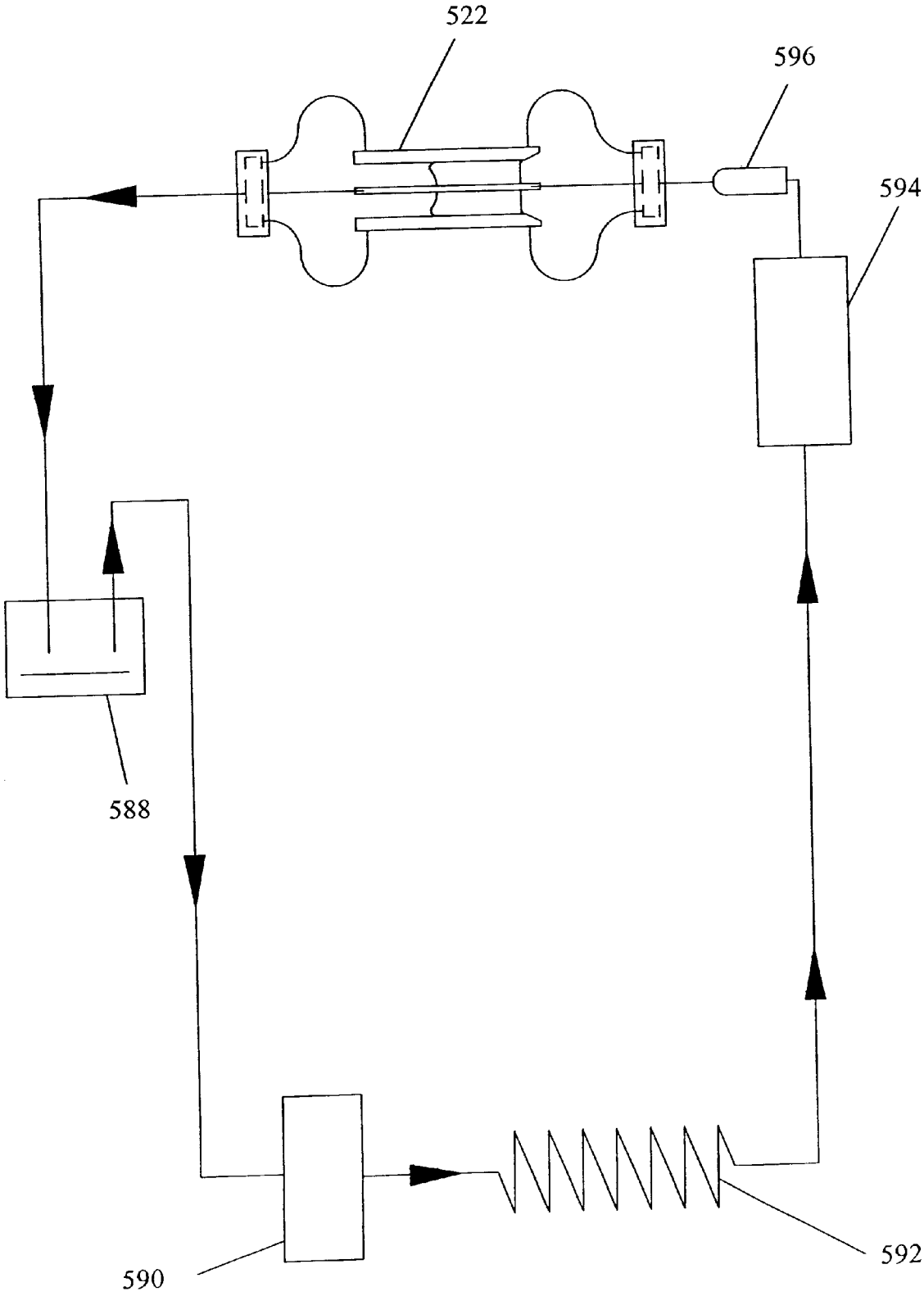
FIG. 21 is a schematic diagram of the refrigeration circuit of the cooling unit in accordance with a seventh embodiment of the self-contained closed-loop cooling unit of the present invention.

Referring to FIG. 21, there is shown a modified cooling circuit for a self-contained closed-loop cooling unit and method for carrying out chill element cooling tasks in accordance with a sixth embodiment of the present invention. This embodiment preferably includes all aspects and preferences of the first embodiment, except that its self-contained closed-loop cooling unit (not shown) that differs from the first embodiment by not including a hyper-chilled coolant circuit. This sixth embodiment of the present invention uses only a refrigeration circuit for cooling, which may be desirable to reduce manufacturing costs or for other reasons. Accordingly, this sixth embodiment of the present invention includes a refrigeration circuit wherein the refrigerant is circulated through the chill elements of the barrel chiller array to remove heat conducted from a beverage and beverage container.

Thus, in this sixth embodiment, the refrigeration circuit disclosed herein and shown in FIG. 21 includes all the elements of the refrigeration circuit as disclosed in the first embodiment, except the chill elements act as the evaporator. Specifically, the refrigeration circuit of the sixth embodiment of the present invention includes an accumulator 588, a compressor 590, a condenser 592, a filter dryer 594, an expansion valve 596, and an evaporator 522. In this embodiment, the expansion valve is located at the inlet to the annular feed manifold and the chill elements 522 collectively act as the evaporator.

During the cooling cycle, the compressed refrigerant is circulated through all the components as in the first embodiment except the chill elements 522 collectively act as the evaporator. The pressure of the refrigerant is reduced as it passes through the expansion valve 596, thereby allowing the refrigerant to evaporate and absorb thermal energy as it passes in parallel through the chill elements 522. The refrigerant then cycles through the annular return manifold and returns through the return line into the accumulator 588. The refrigerant is stored in the accumulator until it is drawn by the compressor 590 where it is pressurized, and circulated through the condenser 592 where it releases thermal energy and changes phases from vapor back to liquid to repeat the cycle.

Those skilled in the field will appreciate that the foregoing illustrated and discussed embodiments of the self-contained closed-loop cooling units and methods of the present invention are subject to modification and change without departing from the scope of the invention as recited in the claims below. Needless to say, the size, proportion, materials, weight and clearances of the various components used in the self-contained closed-loop cooling units of the present invention can be varied as needed or desired. A number of other possible modifications have already been described above, and further changes are clearly possible.

As a first example, if desired, a hinged door or other closure mechanism may be added to the front of the chiller housing, so that the cooling unit of the present invention may be kept closed, such as when the unit is in operation. Such a door or closure mechanism may be provided with an internally protruding pusher surface arranged along the central axis of the chill element array, so that this pusher surface would push or drive the beverage container to be cooled further into the chill element array, thus ensuring the beverage container was lodged to the proper depth into the array. The relative position of the door or closure mechanism if desired may be sensed to ensure that it is in its closed position before the chilling cycle of the cooling unit is allowed to begin.

As a second example, an insulated safety shield or guard member may be attached to or provided on the front of the barrel chiller to help make it more difficult to accidentally touch the extremely cold surfaces of the chill elements or other cold components within the barrel chiller housing. The guard may be made of an thermally insulating polymeric material and may be semi-flexible if desired. For example, a flexible safety membrane may be made of or include a composite rubber, neoprene, or thermoplastic material formed into a squat top-hat like shape having an open central tubular section that is corresponds to the size of the opening of the barrel chiller. This tubular section preferably includes a hole small enough to discourage an adult's hand or other limb portion from entering the tubular array or from contacting other barrel chiller components near the front of the barrel chiller housing. However, the material may be made flexible enough, such as cutting radial or axial slots in it to allow a beverage container to be pushed through for entry into the barrel chiller, and to exit therefrom.

Thus, while the present invention is described in connection with particular examples thereof discussed in the foregoing description and/or shown in the attached drawings, the scope of the invention is not to be so limited. Rather, those skilled in the art should appreciate that the teachings herein can be used in a variety of self-contained closed-loop cooling units and systems, and that this description sets forth only a several exemplary combinations available as part of this invention. It is to be understood that the present invention is by no means limited to the particular constructions herein disclosed and/or shown in the drawings. Instead, the present invention also encompasses any modifications within the scope of the disclosures or fair equivalents thereof, as long as they are covered by the claims set forth below or those claims presented in any regular utility patent application later submitted.

We claim:

1. A self-contained, closed-loop cooling unit for rapidly cooling a beverage container and a beverage retained therein, the cooling unit comprising:

(a) a system support structure;

(b) a barrel chiller attached to the system support structure, the barrel chiller including a generally cylindrical array of hollow elongated chill elements arranged generally parallel to one another circumferentially about a central longitudinal axis of the array, the cylindrical array adapted to receive a beverage container therein, each chill element adapted to transfer heat from a beverage container to a hyper-chilled coolant circulating through the chill element;

(c) a closed-loop coolant circuit including (i) a hyper-chilled liquid coolant retained within the coolant circuit;

(ii) a coolant reservoir attached to the system support structure, the reservoir having an coolant inlet port and a coolant outflow port, the coolant inlet port being in fluid communication with the array and adapted to receive coolant therefrom, the coolant outflow port being in fluid communication with the array and adapted to supply coolant thereto; and (iii) a pump in fluid communication with the reservoir and the array, the pump adapted to propel coolant throughout the coolant circuit;

(d) a refrigeration circuit in thermal communication with the reservoir adapted to remove heat from the reservoir, and maintain the coolant in the reservoir at a hyper-cooled temperature; and wherein the chiller is adapted to receive a beverage container within the array and to rapidly chill the beverage container and beverage retained therein during a cooling cycle, and wherein during the cooling cycle, the pump propels hyper-chilled coolant from the reservoir through the array, whereby heat is transferred from a beverage container into the circulating hyper-chilled coolant and from the hyper-chilled coolant into the environment by operation of the refrigeration circuit.

2. A cooling unit in accordance with claim 1, further comprising:

an electrical control system in electrical communication with the pump, and having a plurality of operator inputs, a plurality of sensors, and a controller adapted to receive inputs from the plurality of sensors and the plurality of operator inputs, and adapted to selectively control operation of the pump, and a housing structure attached to the system support structure, and generally enclosing the cylindrical array at least from the sides and top thereof, and wherein the coolant reservoir is thermally insulated, whereby absorption of heat from the environment is reduced.

3. A cooling unit in accordance with claim 2, the coolant circuit further including at least one valve adapted to interrupt coolant flow through the array.

4. A cooling unit in accordance with claim 3 wherein the valve includes a solenoid valve in electrical communication with the controller.

5. A cooling unit in accordance with claim 2, the coolant circuit further including a plurality of valves, each valve in fluid communication with one chill element, wherein each valve is adapted to interrupt coolant flow through a corresponding chill element.

6. A cooling unit in accordance with claim 2, the electrical control system further including:

a display unit, operatively associated with the chiller, in electrical communication with the controller and a central processing unit (CPU);

at least one random access memory (RAM) module forming part of the controller in electrical communication with the CPU;

at least one memory module forming part of the controller in electrical communication with the CPU;

a plurality of program instructions adapted to direct the CPU, the plurality of program instructions retained within the memory module;

a plurality of readouts in the display unit and in electrical communication with the controller; and wherein the plurality of operator inputs are adapted to receive inputs from an operator, the plurality of inputs being arranged near the display unit and being in electrical communication with the controller, the plurality of sensors are located throughout the cooling unit, each sensor adapted to sense at least one specific condition, each sensor being in electrical communication with the controller, and the controller directs operation of the cooling cycle based on information received from the plurality of operator inputs, the plurality of sensors, and the plurality of program instructions.

7. A cooling unit in accordance with claim 6, the controller further including a selectively programmable memory for storing data related to desired operations of the cooling unit.

8. A cooling unit in accordance with claim 1 wherein the pump is attached to the coolant outflow port, and the coolant circuit further comprises:

a main feed line having a first end and a second end, the first end being attached to the pump;

a feed line header having a distribution side and a conduit side, the conduit side being attached to the second end of the main feed line;

a plurality of chill element feed lines, each having an inlet end and an outlet end, each inlet end attached to the distribution side of the feed line header, each outlet end attached to one of the chill elements of the array;

a plurality of chill element return lines, each having an inflow end and an outflow end, each inflow end being attached to one of the chill elements;

a return header having a distribution side and a conduit side, the distribution side being attached to the outflow end of each chill element return line; and a main return line having a first end and a second end, the first end attached to the conduit side of the return header and the second end attached to the coolant inlet port of the reservoir;

wherein during a cooling cycle the pump propels coolant from the reservoir, through the main feed line, the feed line header, the plurality of chill element feed lines, the cylindrical array, the plurality of chill element return lines, the return header, and back into the reservoir.

9. A cooling unit in accordance with claim 8 wherein the plurality of chill element feed lines and the plurality of chill element return lines are flexible.

10. A cooling unit in accordance with claim 8 wherein the feed line header includes an annular feed manifold, the feed manifold being provided with:

a toroid having an outer lateral face, an opposing inner lateral face, and an inner chamber defined therebetween; and a plurality of feed line connectors on the inner lateral face providing access to the inner chamber, each connector adapted to attach to a chill element feed line.

11. A cooling unit in accordance with claim 1, the refrigeration circuit further comprising:

a refrigerant retained within the refrigeration circuit;

an accumulator attached to the system support structure;

a compressor in fluid communication with the accumulator;

a condenser in fluid communication with the compressor;

a filter dryer in fluid communication with the condenser;

an expansion valve in fluid communication with the filter dryer; and an evaporator located within the reservoir of the coolant circuit, the evaporator having a first end and a second end, the first end being in fluid communication with the expansion valve, the second end being in fluid communication with the accumulator, and wherein the refrigeration circuit absorbs heat through the evaporator from the coolant retained within the reservoir, and transfers heat to the environment through the condenser.

12. A cooling unit in accordance with claim 1, the cylindrical array further comprising a plurality of spacing means, each spacing means being associated with at least one of the chill elements and adapted to help prevent its associated chill element from making contact with an adjacent chill element.

13. A cooling unit in accordance with claim 12, the cylindrical array further comprising a plurality of spring members surrounding the chill elements and bearing against the spacing means, biasing them toward to the central longitudinal axis of the array.

14. A cooling unit in accordance with claim 13 wherein each spacing means is a keystone spacer having a first and second opposed lateral contact surfaces, and the spring members are coiled springs arranged circumferentially around the array of chill elements.

15. A cooling unit in accordance with claim 14 wherein each lateral contact surface includes at least one mechanical means adapted to reduce the contact area between a first contact surface on a first keystone spacer and an opposing second contact surface on an adjacent second keystone spacer.

16. A cooling unit in accordance with claim 14, wherein there are provided a plurality of bumps on the first contact surface of each keystone spacer, the plurality of bumps being arranged to define a recess therebetween, and at least one bump on the opposing second contact surface of each keystone spacer, the one bump being adapted to be received by the recess on the first contact surface of an adjacent keystone spacer, whereby the recess of each first contact surface contactingly receives a corresponding bump of a second contact surface of an adjacent keystone spacer.

17. A cooling unit in accordance with claim 14 wherein each keystone spacer is made from a thermoplastic material.

18. A cooling unit in accordance with claim 1 wherein the array of chill elements is adapted to receive an irregularly shaped object.

19. A cooling unit in accordance with claim 1 wherein at least a plurality of chill elements of the cylindrical array are segmented, with adjacent segments of each segmented chill element being flexibly disposed relative to one another.

20. A cooling unit in accordance with claim 1 wherein:

the array is sufficiently elongated to receive a plurality of 12-ounce aluminum can beverage containers axially arranged with respect to one another, and the chiller includes an ejection device operative to eject a beverage container from within the cylindrical array, whereby the container is extracted from the chiller upon completion of the cooling cycle.

* * * * *